US007198012B2

(12) United States Patent
Suga et al.

(10) Patent No.: US 7,198,012 B2
(45) Date of Patent: Apr. 3, 2007

(54) VALVE TIMING CONTROL APPARATUS FOR INTERNAL COMBUSTION ENGINE

(75) Inventors: Seiji Suga, Kanagawa (JP); Tomoya Tsukada, Kanagawa (JP); Hidekazu Yoshida, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/043,077

(22) Filed: Jan. 27, 2005

(65) Prior Publication Data

US 2005/0166877 A1 Aug. 4, 2005

(30) Foreign Application Priority Data

Jan. 30, 2004 (JP) ..... 2004-024650

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS 6,155,219 A * 12/2000 Fukuhara et al. ..... 123/90.17
6,250,266 B1 * 6/2001 Okui et al. ..... 123/90.17
2004/0154568 A1 8/2004 Yamauchi et al.

FOREIGN PATENT DOCUMENTS

JP 11-141313 A 5/1999
JP 2004-257373 A 9/2004

* cited by examiner

*Primary Examiner*—Thomas Denion
*Assistant Examiner*—Zelalem Eshete
(74) *Attorney, Agent, or Firm*—Foley & Lardner LLP

(57) ABSTRACT

A valve timing control apparatus includes first and second valve timing control operating sections. The first operating section is arranged to alter a rotational phase of a first output member with respect to a first input member driven by an internal combustion engine. The second operating section is arranged to alter a rotational phase of an intake or exhaust camshaft of the engine with respect to the first output member.

40 Claims, 24 Drawing Sheets

VALVE TIMING CONTROL APPARATUS FOR INTERNAL COMBUSTION ENGINE

BACKGROUND OF THE INVENTION

The present invention relates to technique of controlling a valve timing of an intake valve and/or an exhaust valve of an internal combustion engine.

A Published Japanese Patent Application Publication No. H11(1999)-141313 shows a valve timing control system including a first operating mechanism for varying the rotational phases of intake and exhaust camshafts simultaneously, and a second operating mechanism for varying the rotational phase of one of the intake and exhaust camshafts. The shift of a rotational phase is achieved by advancing or retarding the phase with respect to the rotational direction of each camshaft. This angle is referred to as a valve timing control conversion angle.

SUMMARY OF THE INVENTION

The valve timing control system of the above-mentioned publication is arranged to achieve a larger conversion angle by using the two operating mechanisms. However, the first operating mechanism is arranged to alter the phases of both intake and exhaust camshafts. Therefore, it is difficult to shift both camshafts receiving reaction forces from valve springs, with a limited amount of energy in an energy source, and a control response in the valve timing control tends to be worse.

It is, therefore, an object of the present invention to provide valve timing control apparatus improved in the conversion angle and response characteristic.

According to one aspect of the present invention, a valve timing control apparatus for an internal combustion engine, comprises: a first operating section including a first input member adapted to receive rotation from the engine, and a first output member, the first operating section being arranged to alter a rotational phase of the first output member with respect to the first input member; and a second operating section including a second input member connected with the first output member by a connecting member, and a second output member adapted to operate a cam of the engine; the second operating section being arranged to alter a rotational phase of the second output member with respect to the second input member.

According to another aspect of the invention, a valve timing control apparatus, comprises: a drive transmission member adapted to be driven by the engine; a first follower member arranged to rotate relative to the drive member; a second follower member connected with the first follower member by a connecting member; a camshaft arranged to rotate relative to the second follower member; a first operating mechanism arranged to alter a rotational phase between the drive transmission member and the first follower member; and a second operating mechanism arranged to alter a rotational phase between the second follower member and the camshaft.

According to still another aspect of the invention, a valve timing control apparatus comprises: operating means for shifting a valve timing of the engine in one of an advance direction and a retard direction by a control angle determined by adding a first operation angle and a second operation angle; and controlling means for controlling the first operation angle and the second operation angle independently.

DETAILED DESCRIPTION OF THE INVENTION

A FIRST EMBODIMENT according to the present invention is illustrated in FIGS. 1–10.

Figure 1:
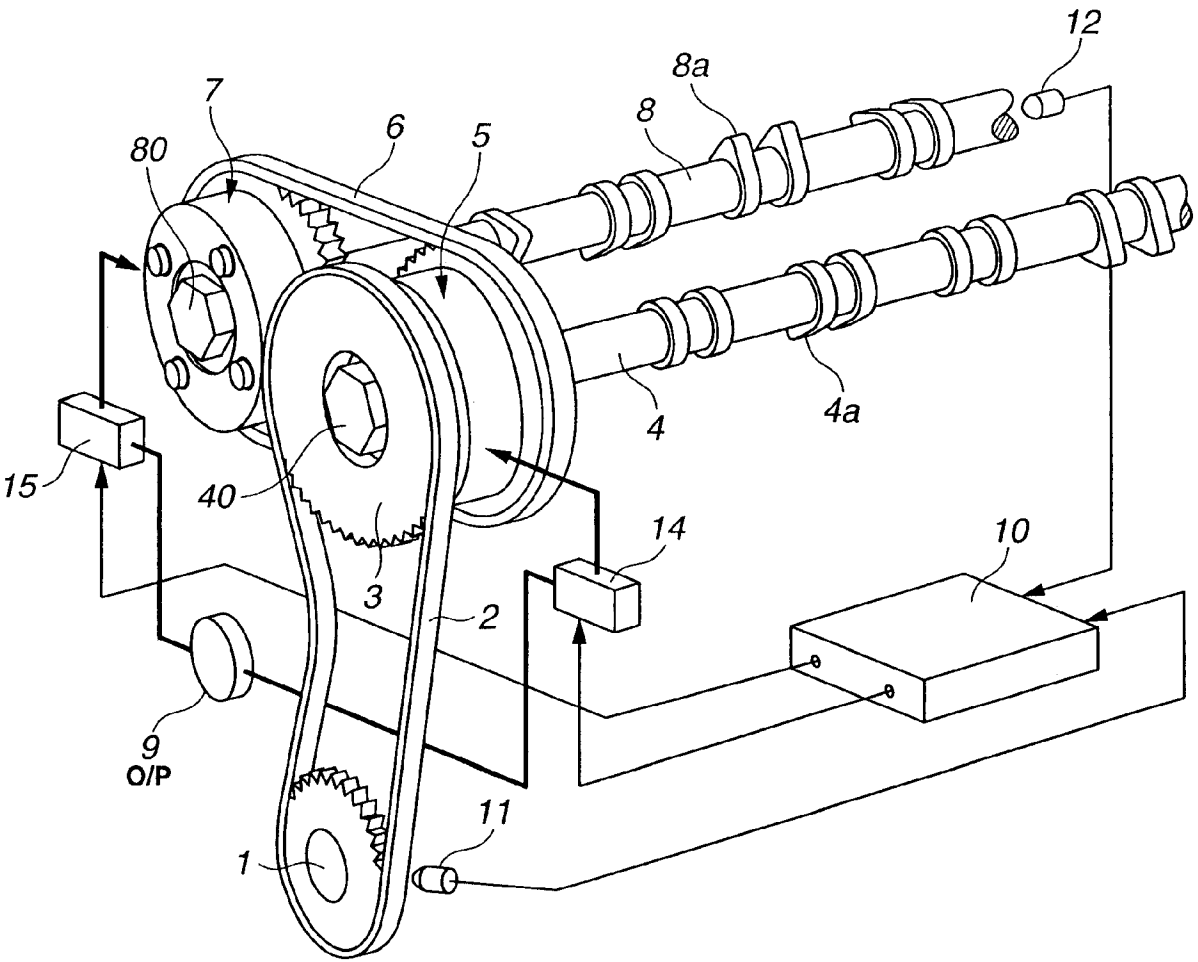
FIG. 1 is a schematic perspective view showing a valve timing control apparatus according to a first embodiment of the present invention.

As schematically shown in FIG. 1, an engine valve timing control apparatus or system according to the first embodiment includes a first valve timing control mechanism 5 provided at one end of an exhaust camshaft 4 having a plural of exhaust cams 4*a* for operating exhaust valves of an engine, and a second valve timing control mechanism 7 provided at one end of an intake camshaft 8 having a plurality of intake cams 8*a* for operating intake valves of the engine. The first and second valve timing control mechanisms 5 and 7 serve as first and second operating mechanisms, respectively. In this example, the intake cams 8*a* are integrally formed on intake camshaft 8, and exhaust cams 4*a* are integrally formed on exhaust camshaft 4. Both mechanism 5 and 7 are located on the same axial side of the parallel camshafts 4 and 8, that is on the left side as viewed in FIG. 1.

A crankshaft 1 of the engine is connected with a drive sprocket 3 serving as a drive transmission member, by a chain 2. In this example, the drive sprocket 3 is designed to rotate at a one-half crankshaft speed.

The drive sprocket 3, together with a first vane rotor 55, is fixed to the end of exhaust camshaft 4 by a first cam bolt 40, so that drive sprocket 3, first vane rotor 55 and exhaust camshaft 4 rotate as a unit. (In this example, either or both of the drive sprocket 3 and first vane rotor 55 can serve as an input member of first valve timing control mechanism 5.) The first vane rotor 55 is housed rotatably in a first housing 50 so that first vane rotor 55 can rotate relative to first housing 50. The first housing 50 serves as a first follower member.

A second vane rotor 75 is fixed to the end of intake camshaft 8 by a second cam bolt 80 so that the second vane rotor 75 and intake camshaft 8 rotate as a unit. The second vane rotor 75 is housed rotatably in a second housing 70 serving as a second follower member. The second vane rotor 75 can rotate relative to second housing 70.

The first and second housings 50 and 70 are connected by a chain 6 serving as a connecting member or a rotation transmission member so that rotation of first housing 50 is transmitted synchronously in an in-phase mode to second housing 70. The chain 6 is set between a first sprocket 53*a* formed integrally in first housing 50 and a second sprocket 73*a* formed integrally in second housing 70. Rotation is transmitted in the in-phase mode without phase change from first sprocket 53*a* of first housing 50 to second sprocket 73*a* of second housing 70. When rotation is transmitted between the first vane rotor 55 and first housing 50, and between the second vane rotor 75 and second housing 70, rotation inputted to drive sprocket 3 from the engine is transmitted to intake camshaft 8 through first and second sprockets 53*a* and 73*a*.

Rotation is transmitted between first vane rotor 55 and first housing 50, and between second vane rotor 75 and second housing 70, through an operating oil supplied from an oil pump 9 driven by the engine. In this embodiment, the single oil pump 9 is used for both of first and second valve timing control mechanisms 5 and 7. By adjusting the supply and drainage of the operating oil, this valve timing control system can vary the relative rotational phase between first vane rotor 55 and first housing 50 and the relative rotational phase between second vane rotor 75 and second housing 70. The valve timing control system can vary the relative rotational phase of intake cam shaft 8 relative to the rotation of crankshaft 1 by shifting the angular position of first housing 50 (which can serve as an output member of first VTC mechanism 5) with respect to first vane rotor 55 (which can serve as the input member of the first VTC mechanism 5), and the angular position of second housing 70 (which can serve as an input member of second VTC mechanism 7) with respect to second vane rotor 75 (which can serve as an output member of second VTC mechanism 7). In this example, exhaust camshaft 4 and drive sprocket 3 are fixed together so that exhaust camshaft 4 rotates as a unit with drive sprocket 3 driven by crankshaft 1. Therefore, the valve timing control system of this example cannot vary the relative rotational phase of exhaust camshaft 4 relative to the rotation of crankshaft 1.

A first hydraulic control device (or first hydraulic control actuator) 14 serving as a first oil regulating mechanism is provided between the oil pump 9 and first VTC mechanism 5, and arranged to regulate the supply and drainage of the operating fluid for the first VTC mechanism 5. A second hydraulic control device (or second hydraulic control actuator) 15 serving as a second oil regulating mechanism is provided between oil pump 9 and second VTC mechanism 7, and arranged to control the supply and drainage of the operating fluid for the second VTC mechanism 7.

A controller 10 controls the first and second hydraulic control devices 14 and 15 independently from each other, by producing respective control signals, in accordance with one or more engine operating conditions. In this example, a sensor group for collecting information on engine operating conditions includes at least a water temperature sensor for sensing an engine temperature; a crank angle sensor 11 provided in the vicinity of crankshaft 1 and arranged to serve as an engine speed sensor for sensing an engine speed (rpm); and an engine load sensor for sensing an engine load by sensing a throttle valve position in this example. The controller 10 receives signals from these sensors and produces the control signals for the first and second hydraulic control devices 14 and 15 in accordance with the sensed engine temperature, engine speed, engine load, etc. Near the other end of intake camshaft 8, there is provided an intake cam angle sensor 12 for sensing the angular or rotational position of intake camshaft 8. The control unit 10 receives the signal from the intake cam angle sensor 12, and controls the actual cam angle of intake camshaft 8 in a manner of feedback control by comparing the sensed actual camshaft angle with a desired target angle. The controller 10 can serve as a main component of controlling means for controlling the first operation angle and the second operation angle independently.

Figure 2:
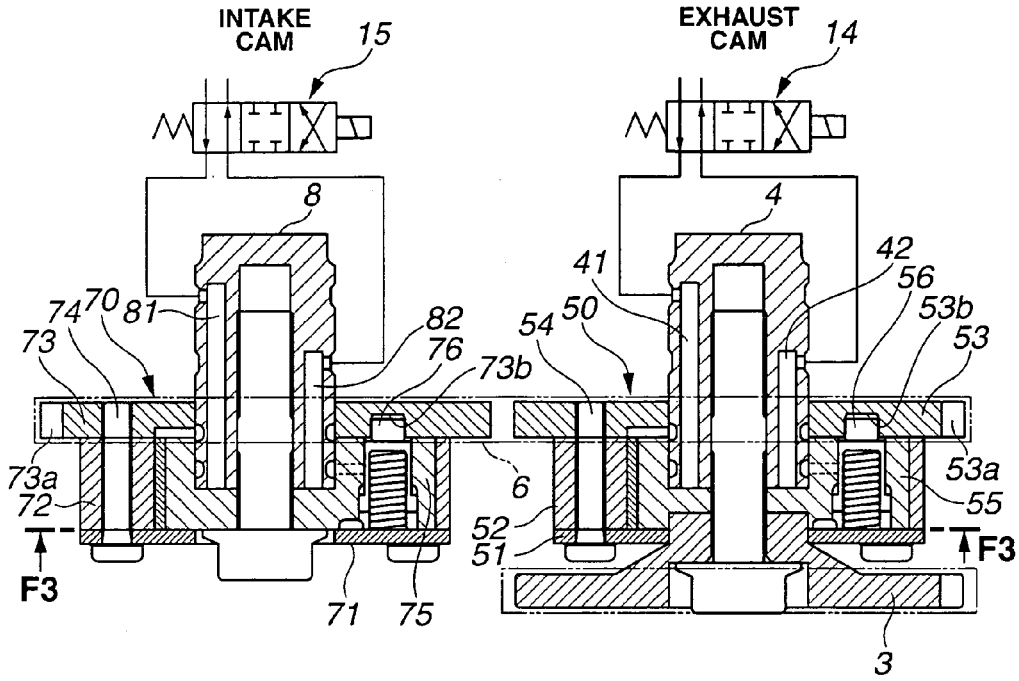
FIG. 2 is a sectional view showing first and second valve timing control mechanisms of the valve timing control apparatus of FIG. 1 in an engine start initial state, taken across a line F2—F2 shown in FIG. 3.
Figure 3:
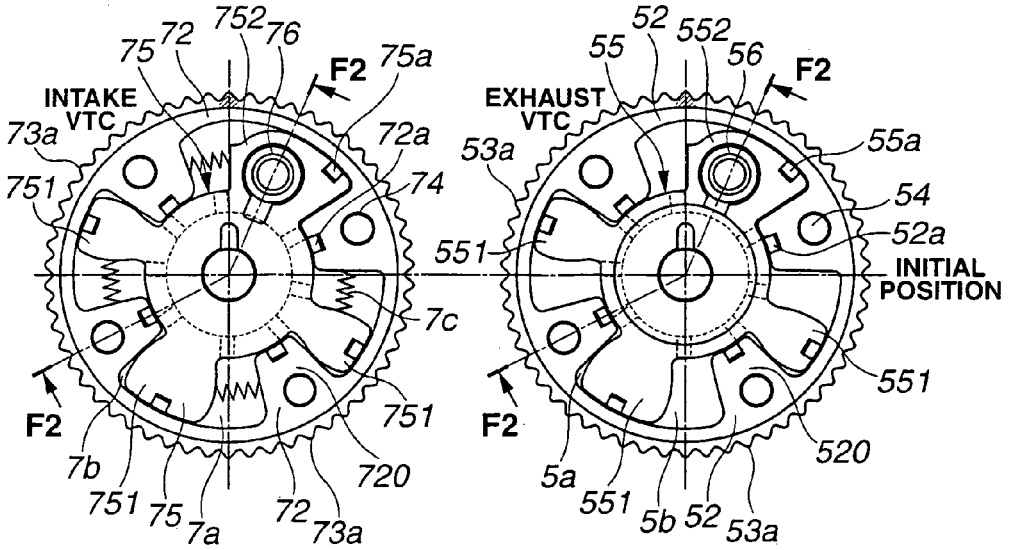
FIG. 3 is a sectional view showing the first and second valve timing control mechanisms in an engine start initial state, taken across a line F3—F3 shown in FIG. 2.
Figure 6:
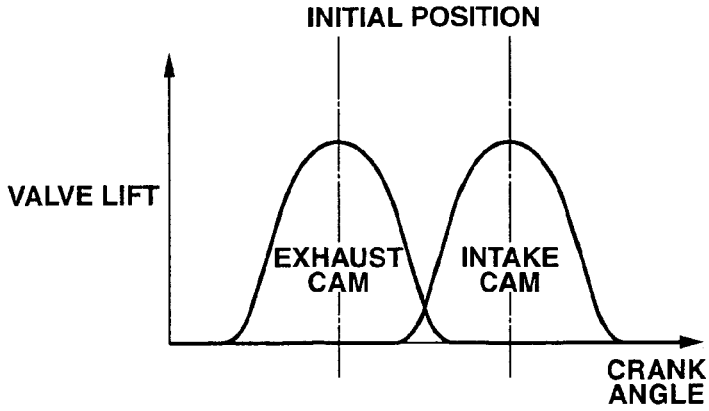
FIG. 6 is a diagram showing a relationship between the crank angle and valve lift in the engine start initial state in the first embodiment.

FIGS. 2 and 3 show first and second VTC mechanisms 5 and 7 in an initial state at the time of engine start operation in axial section and cross section. FIG. 2 is a sectional view taken across a line F2—F2 shown in FIG. 3; and FIG. 3 is a sectional view taken across a line F3—F3 shown in FIG. 2. FIG. 6 is a valve timing linear diagram showing a relationship between the valve lift and crank angle in the initial state at the time of engine start operation.

[Construction of first valve timing control mechanism] First VTC mechanism 5 includes a plurality of operating chambers formed in first housing 50 and a plurality of vanes 551, 552 formed in first vane rotor 55. In this example, first housing 50 has four of the operating chambers, and first vane rotor 55 has four of the vanes 551, 552 each of which is received in a unique one of the four operating chambers. Each operating chamber is divided into a first advance chamber 5*a* and a first retard chamber 5*b* by a corresponding one of the vanes 551, 552. Each of the advance chambers 5*a* is connected with an advance fluid passage 41; and each of the retard chambers 5*b* is connected with a retard fluid passage 42. Under the control of controller 10, first hydraulic control device 14 controls the supply and drainage of the operating oil selectively to and from the advance and retard chambers 5*a* and 5*b* through advance and retard passages 41 and 42.

First housing 50 includes a first front member (or plate) 51, a first housing member 52 and a first rear member (or plate) 53 which are joined together, into the single first housing 50, by a plurality (four) of axially extending fastening devices 54 which are in the form of bolts 54 in this example. First housing member 52 is sandwiched axially between first front and rear members 51 and 53. First front member 51 faces toward the drive sprocket 3; and first front member 51 is located axially between drive sprocket 3 and first housing member 52. First front member 51 is in the form of a relatively thin circular disk. First housing member 52 encloses first vane rotor 55 and includes a plurality (four) of inward projections (shoes) 520 projecting radially inwards and thereby defining a plurality (four) of the operating chambers. First rear plate 53 is in the form of a plate, and first rear plate 53 is thicker than first front plate 51 as shown in FIG. 2. First rear plate 53 is formed with a center hole receiving exhaust camshaft 4. Bolts 54 are inserted from the front side, and first front plate 51 is clamped between the heads of bolts 54 and first housing member 52. The before-mentioned first sprocket 53*a* is formed integrally in the outer circumference of first rear member 53. First rear member 53 is mounted on exhaust camshaft 4, and arranged to support first housing 50 on exhaust camshaft 4.

First vane rotor 55 is formed with a plurality (four) of the vanes 551, 551, 551 and 552 projecting radially outwards at approximately regular angular intervals around the center axis. One of the vanes is a wider vane 552 which is wider in the circumferential direction than the remaining (three) vanes 551, as shown in FIG. 3. Wider vane 552 is formed with an axially extending hole receiving therein a first lock pin 56 serving as a first holding device.

First lock pin 56 is axially slidable in the axial hole of wider vane 552, and is normally urged by a resilient member such as a spring toward the first rear plate 53. First rear plate 53 is formed with a first lock hole 53*b* for receiving the first lock pin 56. In the state of FIG. 2, the first lock pin 56 is engaged in first lock hole 53*b*. When the oil pressure is applied through advance passage 41 or retard passage 42, the first lock pin 56 is disengaged from the first lock hole 53*b* against the resilient force of the spring.

In the engine start operation, the first lock pin 56 is engaged in the first lock hole 53*b* (that is, the first lock pin 56 is in a lock position), and hence the first housing 50 and first vane rotor 55 rotate as a unit. When first lock pin 56 is disengaged from first lock hole 53*b* (that is, the first lock pin 56 is in a release or unlock position), the first housing 50 and first vane rotor 55 can rotate relative to each other. Thus, the first lock pin 56 holds the first housing 50 and vane rotor 55 engaged as a unit even when a sufficient oil pressure is not available, and thereby prevents undesired flapping due to alternating torque produced by the action of valve springs and cams.

A seal member 55*a* of resin is provided in a groove in the outer end of each vane 551, 552 of vane rotor 55, and urged radially outwards by a plate spring, to an inside cylindrical surface of first housing member 52, to seal a sliding contact region between first vane rotor 55 and first housing 50. On the other hand, a seal member 52*a* of resin is provided in a groove formed in the inner end of each inward projection (or shoe) 520 of first housing 50, and urged radially inwards by a plate spring, to an outside cylindrical surface of first vane rotor 55, to seal a sliding contact region between first vane rotor 55 and first housing 50. Therefore, each vane 551, 552 defines the first advance and retard chambers 5*a* and 5*b* liquid tightly on both sides. In this example, the rotational direction is clockwise as viewed in FIG. 3. However, the invention is not limited to this arrangement.

In the engine start initial state at the time of an engine starting operation, the first vane rotor 55 is locked at a most retarded position by the first lock pin 56 engaging in the first lock hole 53*b*, so that the first vane rotor 55 and first housing 50 rotate as a unit. However, when the operating oil is supplied to the first advance chambers 5*a* or the first retard chambers 5*b* from oil pump 9, the oil pressure is applied to the first lock pin 56 against the spring, and the first lock pin 56 is disengaged from the first lock hole 53*b*.

When the operating oil is supplied to the first advance chambers 5*a*, then the first housing 50 rotates in the advance direction with respect to the first vane rotor 55, and thereby provides a VTC operating angle in the advance direction. When the operating oil is supplied to the first retard chambers 5*b*, then the first housing 50 rotates in the retard direction with respect to the first vane rotor 55, and thereby provides the VTC operating angle in the retard direction. The relative rotation between first housing 50 and first vane rotor 55 is limited within a limited range. The range of the relative rotation between first housing 50 and first vane rotor 55 is determined by the circumferential widths of vanes 551, 552 and inward projections (or shoes) 520. It is possible to adjust the range of the relative rotation by varying the circumferential widths of the vanes and/or inward projections 520.

[Construction of second valve timing control mechanism] Second VTC mechanism 7 includes a plurality (four) of operating chambers formed in second housing 70 and a plurality (four) of vanes 751, 752 formed in second vane rotor 75. In this example, second housing 70 has four of the operating chambers, and second vane rotor 75 has four of the vanes 751, 752 each of which is received in a unique one of the fourth operating chambers. Each operating chamber is divided into a second advance chamber 7*a* and a second retard chamber 7*b* by a corresponding one of the vanes 751, 752. Each of the advance chambers 7*a* is connected with an advance fluid passage 81; and each of the retard chambers 7*b* is connected with a retard fluid passage 82. Under the control of controller 10, first hydraulic control device 15 controls the supply and drainage of the operating oil selectively to and from the advance and retard chambers 7*a* and 7*b* through advance and retard passages 81 and 82. The first and second first hydraulic control devices 14 and 15 are controlled independently. Controller 10 produces the respective control signals to first and second devices 14 and 15, independently from each other.

Second housing 70 includes a second front member (or plate) 71, a second housing member 72 and a second rear member (or plate) 73 which are joined together, into the single second housing 70, by a plurality (four) of axially extending fastening devices 74 which are in the form of bolts 74 in this example. Second housing member 72 is sandwiched axially between second front and rear members 71 and 73. Second front member 71 faces forward away from intake camshaft 8. Second front member 71 is in the form of a relatively thin circular plate or disk. Second housing member 72 encloses second vane rotor 75 and includes a plurality (four) of inward projections (shoes) 720 projecting radially inwards and thereby defining a plurality (four) of the operating chambers. Second rear member 73 is in the form of a plate, and is thicker than second front plate 71 as shown in FIG. 2. Second rear plate 73 is formed with a center hole receiving intake camshaft 8. Bolts 74 are inserted from the front side, and second front plate 71 is clamped between the heads of bolts 74 and second housing member 72. The before-mentioned second sprocket 73*a* is formed integrally in the outer circumference of second rear member 73. Second rear member 73 is mounted on intake camshaft 8, and arranged to support second housing 70 on intake camshaft 8.

Second vane rotor 75 is formed with a plurality (four) of the vanes 751, 751, 751 and 752 projecting radially outwards at approximately regular angular intervals around the center axis. One of the vanes is a wider vane 752 which is wider in the circumferential direction than the remaining three vanes 751, as shown in FIG. 3. The wider vane 752 is formed with an axially extending hole receiving therein a second lock pin 76 serving as a second holding device.

Second lock pin 76 is axially slidable in the hole of wider vane 752, and is normally urged by a resilient member such as a spring toward the second rear plate 73. Second rear plate 73 is formed with a second lock hole 73*b* for receiving the second lock pin 76. In the state of FIG. 2, the second lock pin 76 is engaged in second lock hole 73*b*. When the oil pressure is applied through advance passage 81 or retard passage 82, the second lock pin 76 is disengaged from the second lock hole 73*b* against the resilient force of the spring.

In the engine start operation, the second lock pin 76 is engaged in the second lock hole 73*b*, and hence the second housing 70 and second vane rotor 75 rotate as a unit. When second lock pin 76 is disengaged from second lock hole 73*b*, the second housing 70 and second vane rotor 75 can rotate relative to each other. Thus, the second lock pin 76 holds the second housing 70 and vane rotor 75 engaged as a unit even when a sufficient oil pressure is not available, and thereby prevents undesired flapping due to alternating torque produced by the action of valve springs and cams.

An outer seal member 75*a* of resin is provided in a groove in the outer end of each vane 751, 752 of vane rotor 75, and urged radially outwards by a plate spring, to an inside cylindrical surface of second housing member 72, to seal a sliding contact region between second vane rotor 75 and second housing 70. On the other hand, an inner seal member 72*a* of resin is provided in a groove formed in the inner end of each inward projection (or shoe) 720 of second housing 70, and urged radially inwards by a plate spring, to an outside cylindrical surface of second vane rotor 75, to seal a sliding contact region between second vane rotor 75 and second housing 70. Therefore, each vane 751, 752 defines the second advance and retard chambers 7*a* and 7*b* liquidtightly on both sides.

In the engine start initial state at the time of an engine starting operation, the second vane rotor 75 is locked at a most advanced position by the second lock pin 76 engaging in the second lock hole 73*b*, so that the second vane rotor 75 and second housing 70 rotate as a unit. However, when the operating oil is supplied to the second advance chambers 7*a* or the second retard chambers 7*b* from oil pump 9, the oil pressure is applied to the second lock pin 76 against the spring, and the second lock pin 76 is disengaged from the second lock hole 73*b*.

When the operating oil is supplied to the second retard chambers 7*b*, then the second vane rotor 75 rotates in the retard direction with respect to the second housing 70, and thereby provides the VTC operating angle. When the operating oil is supplied to the second advance chambers 7*b*, then the second vane rotor 75 rotate in the advance direction with respect to the second housing 70, and thereby provides the VTC operating angle. The range of the relative rotation between second housing 70 and second vane rotor 75 is limited, and determined by the circumferential widths of vanes 751, 752 and inward projections (or shoes) 720. It is possible to adjust the range of the relative rotation by varying the circumferential widths of the vanes and/or inward projections.

A resilient member 7*c* in the form of a coil spring is disposed in each of the second advance chambers 7*a*, as shown in FIG. 3. Each resilient member 7*c* is disposed between the second housing member 72 (one of the inward projections 720) and the second vane rotor 75. By the resilient members 7*c*, the second vane rotor 75 is urged in the advance direction with respect to the second housing 70. The resilient forces of resilient members 7*c* are so set that the advance torque in the advance direction is greater than the retard torque in the alternating torque produced by the valve springs and cams. Therefore, when the oil supply from oil pump 9 is stopped and the oil pressure becomes lower in the second advance and retard chambers 7*a* and 7*b*, the second vane rotor 75 returns to the most advanced position, that is the state at the time of engine start operation, by the alternating torque. Each resilient member 7*c* may be a torsion spring, a plate spring or a spiral spring, instead of a coil spring.

[Relation between crankshaft and camshafts] The valve timing control system according to this embodiment determines the phases of exhaust camshaft 4 and intake camshaft 8 with respect to the rotation of crankshaft 1 in the following manner. When the crankshaft 1 rotates, the drive sprocket 3 is rotated through chain 2. The exhaust camshaft 4 is fixed to drive sprocket 3. Therefore, in this example, the phase of exhaust camshaft 4 is invariable with respect to crankshaft 1.

When exhaust camshaft 4 rotates, the first vane rotor 55 rotates as a unit with exhaust camshaft 4. In the engine start state of the most retarded or fully retarded position, the rotation of first vane rotor 55 is transmitted directly to first housing 50 by the first lock pin 56. When, on the other hand, first vane rotor 55 is out of the most retarded position, the rotation is transmitted through the oil in first advance chambers 5*a* from first vane rotor 55 to first housing 50.

The rotation of first housing 50 is transmitted synchronously to second housing 70 by chain 6 between first and second sprockets 53*a* and 73*a*. In the engine start state in which second vane rotor 75 is at the most advanced or fully advanced position, the rotation of second housing 70 is transmitted directly to second vane rotor 75 by the second lock pin 76, and further to the intake camshaft 8 fixed with second vane rotor 75. When, on the other hand, second vane rotor 75 is out of the most advanced position, the rotation is transmitted through the oil in second retard chambers 7*b* from second housing 70 to second vane rotor 75.

(Valve timing control only by the first valve timing control mechanism) The valve timing control system is operated in the following manner when the valve timing control is performed only by the first VTC mechanism 5. Advance Control: In the case of the advance control of first VTC mechanism 5, the fluid pressure is supplied to first advance chambers 5*a*, and the phase of first housing 50 is shifted in the advance direction so as to produce the VTC operation angle in the advance direction. At the same time, the chain 6 acts to shift the phase of second housing 70 and hence the phase of intake camshaft 8. In other words, the exhaust camshaft 4 rotates in phase with crankshaft 1 whereas the phase of intake camshaft 8 is advanced by the amount of the operation angle of first VTC mechanism 5. Thus, intake camshaft 8 obtains the VTC conversion angle (or total control angle) to shift the phase in the advance direction by the amount determined by the first VTC mechanism 5. Retard Control: In the case of the retard control of first VTC mechanism 5, the fluid pressure is supplied to first retard chambers 5*b*, and the phase of first housing 50 is shifted in the retard direction so as to produce the VTC operation angle in the retard direction. At the same time, the chain 6 acts to shift the phase of second housing 70 and hence the phase of intake camshaft 8. In other words, the exhaust camshaft 4 rotates in phase with crankshaft 1 whereas the phase of intake camshaft 8 is retarded by the amount of the operation angle of first VTC mechanism 5. Thus, intake camshaft 8 obtains the VTC conversion angle (or total control angle) to shift the phase in the retard direction by the amount determined by the first VTC mechanism 5. The VTC conversion angle of intake camshaft 8 is controlled to a value equal to the sum of the first VTC operating angle of first VTC mechanism 5, and the second VTC operating angle of second VTC mechanism 7 which is held equal to zero in this case.

(Valve timing control only by the second valve timing control mechanism) The valve timing control system is operated when the valve timing control is performed only by the second VTC mechanism 7. Advance Control: In the case of the advance control of second VTC mechanism 7, the fluid pressure is supplied to second advance chambers 7*a*, and the phase of second vane rotor 75 is shifted in the advance direction so as to produce the operation angle in the advance direction. In other words, the exhaust camshaft 4 rotates in phase with crankshaft 1, and the first and second housings 50 and 70 are also in phase. Only the phase of intake camshaft 8 is advanced by the amount of the operation angle of second VTC mechanism 7. Thus, intake camshaft 8 receives the conversion angle (or control angle) to shift the phase in the advance direction by the amount determined by the second VTC mechanism 7. Retard Control: In the case of the retard control of second VTC mechanism 7, the fluid pressure is supplied to second retard chambers 7*b*, and the phase of second vane rotor 75 is shifted in the retard direction so as to produce the operation angle in the retard direction. In other words, the exhaust camshaft 4 rotates in phase with crankshaft 1, and the first and second housings 50 and 70 are in phase with the crankshaft rotation. Only the phase of intake camshaft 8 is retarded by the amount of the operation angle of second VTC mechanism 7. Thus, intake camshaft 8 receives the conversion angle (or control angle) to shift the phase in the retard direction by the amount determined by the second VTC mechanism 7. The VTC conversion angle of intake camshaft 8 is controlled to a value equal to the sum of the first VTC operating angle of first VTC mechanism 5 which is held equal to zero, and the second VTC operating angle of second VTC mechanism 7.

Thus, in the valve timing control system according to the first embodiment, the first and second VTC mechanisms 5 and 7 are both arranged to shift the phase of intake camshaft 8 with respect to crankshaft 1. The phase of intake camshaft 8 with respect to the crankshaft is shifted by the conversion angle (or valve timing control angle) which is equal to the sum of the VTC operation angle of first VTC mechanism 5 and the VTC operation angle of second VTC mechanism 7. In this example, the first and second VTC mechanisms 5 and 7 can serve as operating means for shifting an engine valve timing by the amount of the conversion angle determined by adding the first operation angle and the second operation angle. At least one of devices 14 and 15 and controller 10 can serve as controlling means for controlling the first operation angle and the second operation angle independently from each other.

Figure 4:
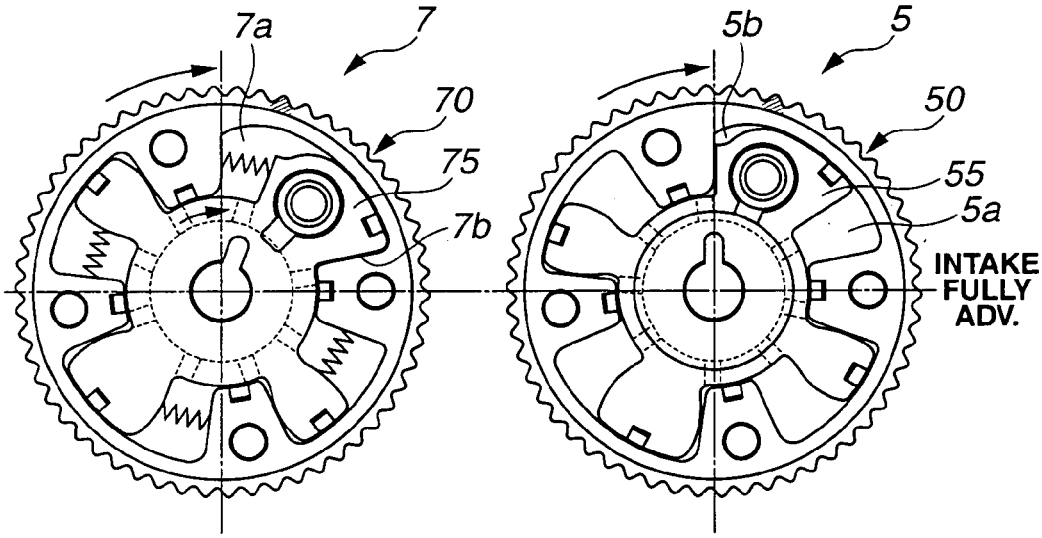
FIG. 4 is a sectional view showing the first and second valve timing control mechanisms of the valve timing control apparatus of FIG. 1, taken across line F3—F3 shown in FIG. 2, in the most advanced state.
Figure 7:
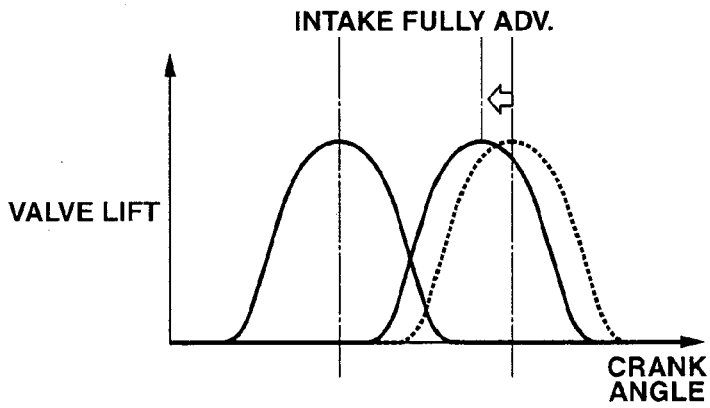
FIG. 7 is a diagram showing a relationship between the crank angle and valve lift in the most advanced state in the first embodiment.

FIG. 4 shows the first and second VTC mechanisms 5 and 7 in the fully advanced state in which the most advanced position is reached from the engine start state. The fully advanced position is attained by controlling only the first VTC mechanism 5 to the most advanced position. FIG. 7 shows the relationships of valve lifts of intake and exhaust valves and the crank angle in the fully advance position. When intake camshaft 8 is controlled to the fully advanced position, the intake valve opens earlier. As compared to the engine start state, the intake valve starts opening earlier before the closure of the exhaust valve, and hence the valve overlap during which the intake and exhaust valves are both open, is increased.

Figure 5:
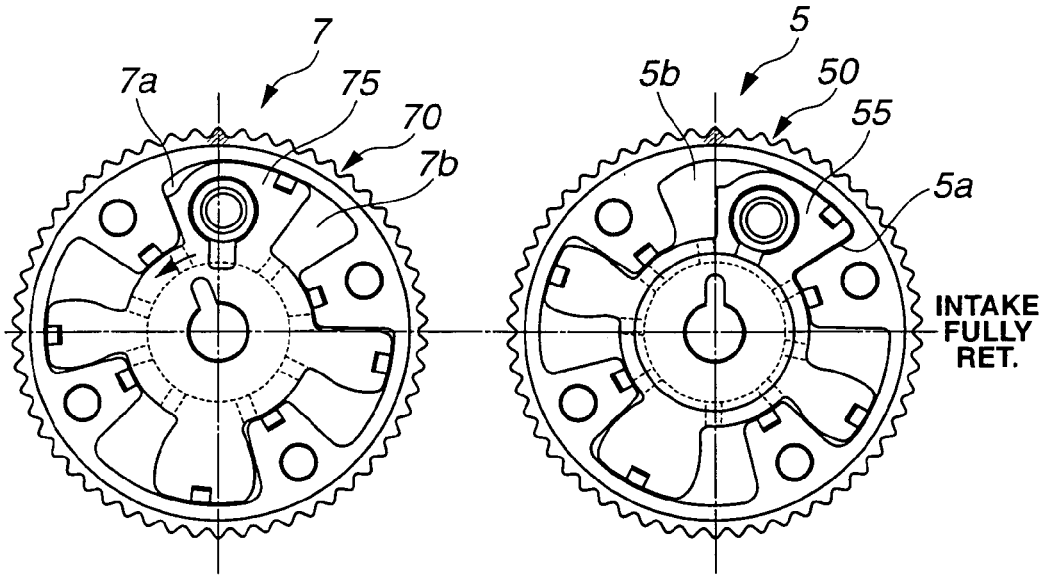
FIG. 5 is a sectional view showing the first and second valve timing control mechanisms of the valve timing control apparatus of FIG. 1, taken across line F3—F3 shown in FIG. 2, in the most retarded state.
Figure 8:
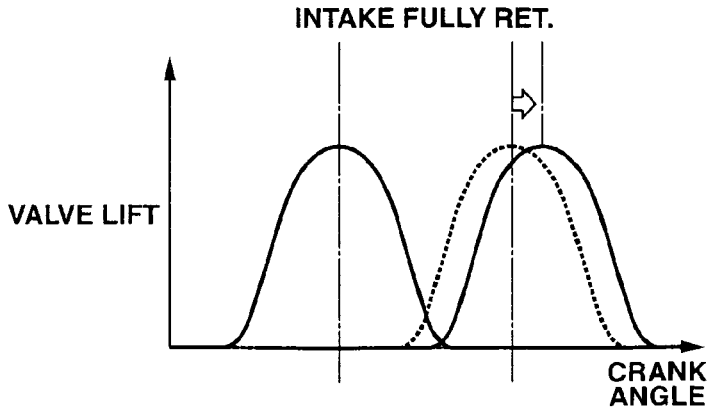
FIG. 8 is a diagram showing a relationship between the crank angle and valve lift in the most retarded state in the first embodiment.

FIG. 5 shows the first and second VTC mechanisms 5 and 7 in the fully retarded state in which the most retarded position is reached from the engine start state. The fully retarded position is attained by controlling only the second VTC mechanism 7 to the most retarded position. FIG. 8 shows the relationships of valve lifts of intake and exhaust valves when intake camshaft 8 is controlled to the fully retarded position. When the intake camshaft 8 is controlled to the fully retarded position, the intake valve opens later. As compared to the engine start state, the intake valve starts opening later with respect to the closure of the exhaust valve, and hence the valve overlap is decreased.

In this way, the first VTC mechanism 5 is initially set at the most retarded position at the time of engine starting, and controlled from the most retarded position to achieve the advance control. The second VTC mechanism 7 is initially set at the most advanced position at the time of engine starting, and controlled from the most advanced position to achieve the retard control. With the first and second timing control mechanisms 5 and 7, this valve timing control system can perform both the advance control and retard control.

[Relation between engine driving condition and valve timing control mechanisms] The first and second VTC mechanism 5 and 7 are operated in dependence on the engine driving condition in the following manner.

Figure 9:
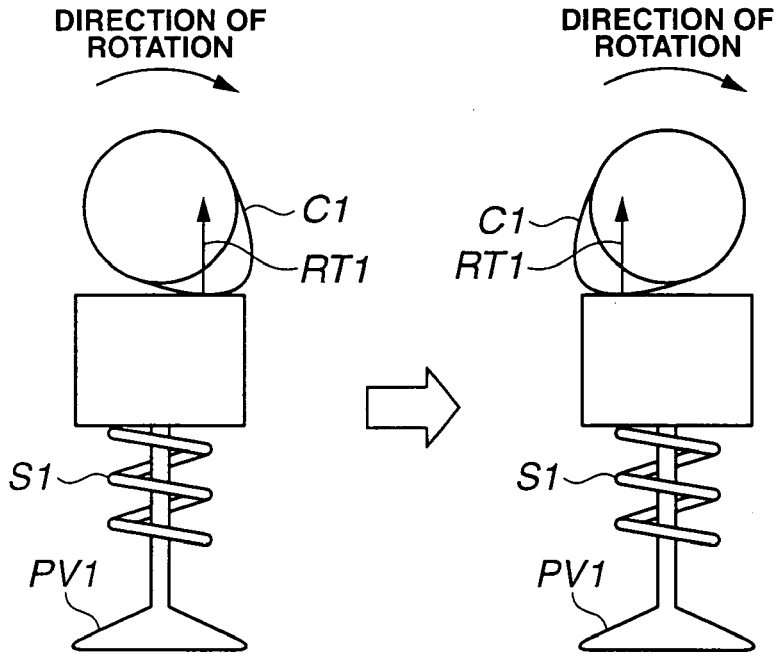
FIG. 9 is a schematic view illustrating alternating torque utilized in the embodiment.

(Alternating Torque) Alternating torque is applied to each of exhaust camshaft 4 and intake camshaft 8. FIG. 9 schematically shows a cam C1, a valve PV1 and a valve spring S1. By rotation in the clockwise direction in FIG. 9, cam C1 pushes down valve PV1 against a counter reactive force RT1 of valve spring S1. Therefore, the camshaft driving cam C1 receives a load of a component in the rotational direction of the force RT1. The load impeding the rotation of the camshaft is defined as a positive torque.

When valve PV1 is closed by further rotation of cam C1, cam C1 receives a component in the rotational direction of the force RT1 by valve spring S1, and the camshaft receives a load in the direction to assist the rotation of the camshaft. The load assisting the rotation of camshaft is defined as a negative load.

Figure 10:
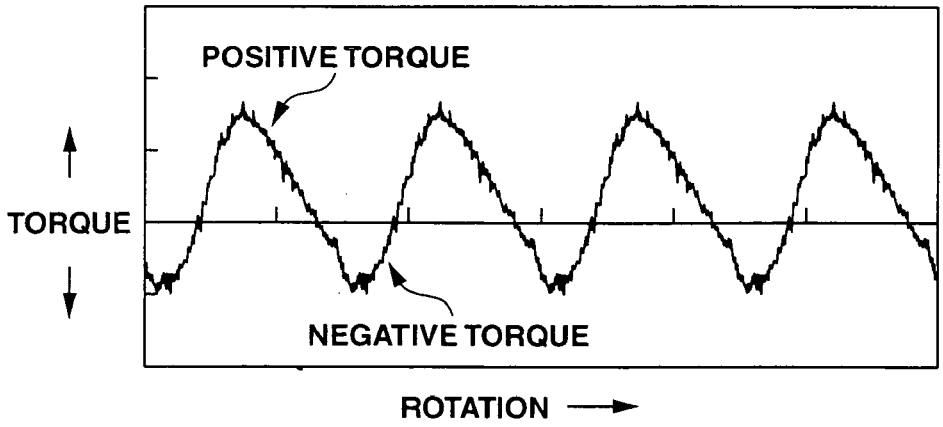
FIG. 10 is a graph showing the alternating torque.

FIG. 10 shows torque variation of a rotating camshaft. As shown in FIG. 10, the component of the force of the valve spring S1 acts alternately in the direction impeding the rotation as the positive torque and in the direction assisting the rotation as the negative toque as the camshaft rotates. Because of the intervention of the sliding contact resistance between cam C1 and valve V1, and the sliding contact resistance in bearing portions of the camshaft, the torque in the camshaft is offset as a whole to the positive toque's side. In this way, the camshaft receives the torque varying alternately between the positive and negative sides with the offset to the positive side.

(When the system is restored to the initial state for engine start before a complete stop of the engine) When the engine is stopped, the valve timing control system normally restores the first and second VTC mechanisms to the engine start state in which the first and second lock pins 56 and 76 are engaged, respectively, in the first and second lock holes 53*b* and 73*b*, as a control end operation. Therefore, the system can control the first and second mechanisms 5 and 7 from the initial engine start state irrespective of whether the oil pressure is available or not, and hence prevent flapping between the vane housing and housing by the alternating torque at the time of engine restart operation.

However, if the engine stalls before the control end operation to restore the first and second mechanisms 5 and 7 to the engine start state, the crankshaft stops after several revolutions due to the inertial force. In this case, even if the exhaust camshaft 4 receives an alternative torque, the influence is not problematical since exhaust camshaft 4 rotates as a unit with crankshaft 1.

On the other hand, an alternating torque acts on intake camshaft 8, too. Since the integral of the alternating torque with respect to the number of revolutions becomes positive, the positive torque is applied in the retarding direction on the second vane rotor 75 rotating as a unit with the intake camshaft 8. In this case, resilient members 7*c* urge the second vane rotor 75 in the advance direction, and the second vane rotor 75 is returned to the most advanced position of the initial engine start state.

When the first housing 50 is positioned on the advance side with respect to first vane rotor 55 in first VTC mechanism 5, a positive torque acting on the second vane rotor 75 (intake camshaft 8) is transmitted through the second lock pin 76 to the second housing 70 in the second VTC mechanism 7 in the engine start state of the most advanced position. Therefore, the first housing 50 is returned in the retard side by the second housing 70, and the first VTC mechanism 5 is restored to the most retarded position. Even if the mechanism is not in the most retarded position of the engine start state, the positive torque is transmitted by the resilient members 7*c* through second housing 70 to first housing 50, so that the mechanism is returned to the most retarded position of the engine start state.

(When the system is not restored to the initial state for engine start before a complete stop of the engine) When the engine stalls before the control end operation to restore the first and second mechanisms 5 and 7 to the engine start state, the system is not in the engine start state at the time of a next engine start operation. In this case, the first vane rotor 55 is rotated by crankshaft 1 in the engine restart operation. Even if the first vane rotor 55 and first housing 50 are disengaged, the first vane rotor 55 is moved to the position in the engine start state. Therefore the first lock pin 56 engages in the first lock hole 53*b*, and thereby prevents flapping between the first vane rotor 55 and first housing 50.

The rotation of first housing 50 is transmitted to second housing 70, and then the rotation of second housing 70 is transmitted through the resilient members 7*c* to the second vane rotor 75. Although the second vane rotor 75 receives an alternating torque as mentioned before, the second vane rotor 75 is urged in the advance direction by the resilient members 7*c*. Therefore, the second lock pin 76 reliably engages in the second lock hole 73*b*, and thereby prevents flapping between the second vane rotor 75 and second housing 70.

(Control operation of the first and second valve timing control mechanisms) The first and second VTC mechanisms 5 and 7 are controlled in the following manner.

CONTROL EXAMPLE 1

In this first control example, the first and second VTC mechanisms 5 and 7 are both controlled in a continuous manner to alter the phase continuously. For the phase-adjustable camshaft (that is, the intake camshaft 8 in this example), the valve timing control system can alter the phase continuously in an entire operating angle range. Accordingly, the system can alter the phase continuously without deteriorating the response characteristic.

(a) In this control example, the first and second VTC mechanisms 5 and 7 are controlled so that both are not operated at the same time. By controlling both mechanisms 5 and 7 in this way, the valve timing control system can prevent excessive consumption of energy in the power source of both mechanisms, and thereby prevent deterioration in the response speed. Especially when the oil pump 9 is used as the source of power, the oil pressure is not consumed at a stretch and the response characteristic of the operation does not become worse. The valve timing control system achieves the advance control from the initial engine start state by controlling only the first VTC mechanism 5 in the advance direction, and achieves the retard control from the initial engine start state by controlling only the second VTC mechanism 7 in the retard direction.

(b) The first and second VTC mechanisms 5 and 7 are controlled to operate simultaneously only during a transient period of changeover from one operating state to another of the first and second mechanism 5 and 7. By controlling the mechanisms 5 and 7 in this way, the control system can alter the phase smoothly and continuously. The phase of the adjustable camshaft (i.e., intake camshaft 8) is varied smoothly and continuously in the entire operating angle range.

CONTROL EXAMPLE 2

In the second control example, one of the first and second VTC mechanisms 5 and 7 is controlled in a continuous manner to alter the phase continuously, and the other VTC mechanism 5 or 7 in a stepwise manner between two different levels. The second example employs the simple control configuration like the on-off control, for one of the VTC mechanisms 5 and 7. Though one VTC mechanism has a simple two-step control configuration, the valve timing control system can alter the phase continuously with the other VTC mechanism. Thus, the phase of the camshaft can be varied continuously in an entire operating angle range. The second control example is effective for reducing the cost.

(a) Preferably, the operating angle of the VTC mechanism 5 or 7 which is controlled in the two step control mode is set smaller than the operating angle of the other VTC mechanism 5 or 7 which is controlled continuously. With this feature, the control system can alter the phase of the camshaft continuously in the entire operating angle range.

(b) When the VTC mechanism 5 or 7 which is controlled in the two step control mode is actuated in one of the advance and retard directions, the continuously-controlled other VTC mechanism 5 or 7 is preferably controlled in the opposite direction. Even when the phase is changed abruptly by the stepwise-controlled VTC mechanism, the system can prevent an abrupt change in the phase by controlling the continuously-controlled VTC mechanism in the direction to reduce the change in the phase.

The chambers 5*a* and 5*b* and vanes 551, 552 can serve as first valve timing control means for altering the phase of a first output rotation with respect to a first input rotation; and the chambers 7*a* and 7*b* and vanes 751, 752 can serve as second valve timing control means for altering the phase of a second output rotation with respect to the first output rotation.

Figure 11:
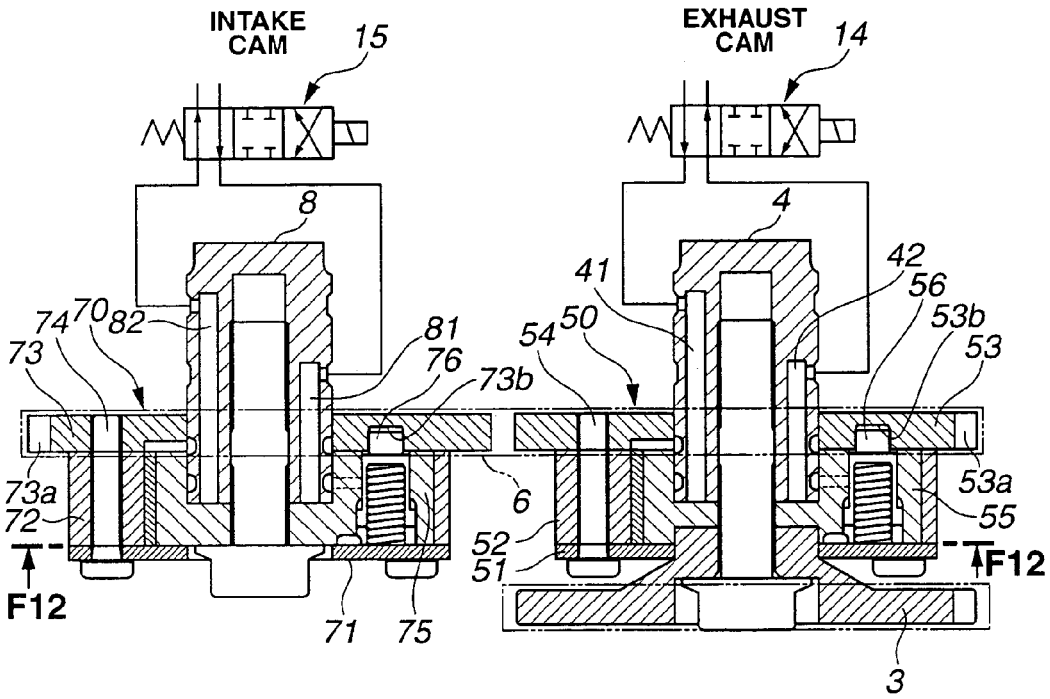
FIG. 11 is a sectional view showing first and second valve timing control mechanisms of a valve timing control apparatus according to a second embodiment in an engine start initial state, taken across a line F11—F11 shown in FIG. 12.
Figure 12:
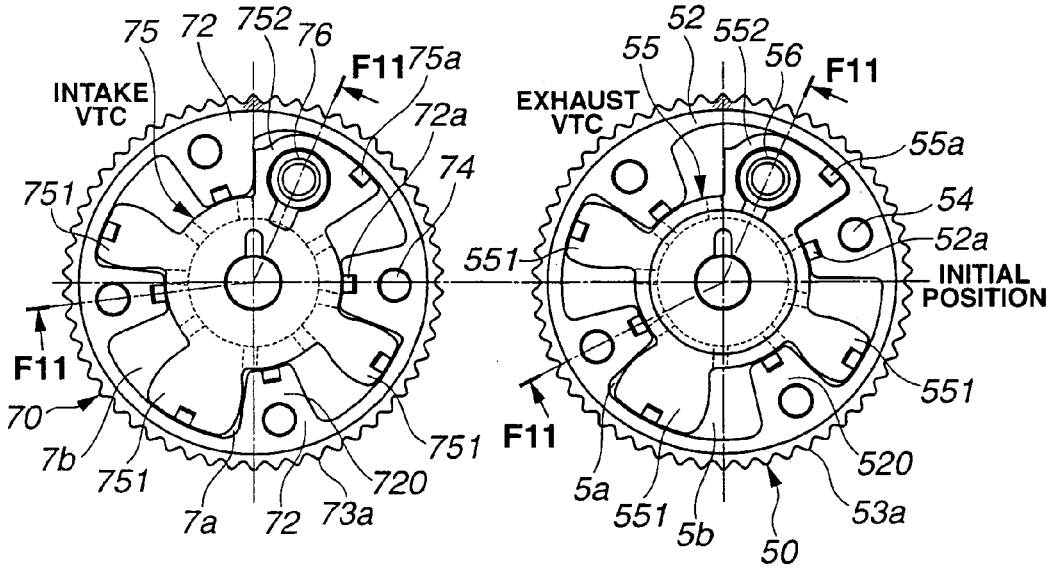
FIG. 12 is a sectional view showing the first and second valve timing control mechanisms in an engine start initial state, taken across a line F12—F12 shown in FIG. 11.
Figure 13:
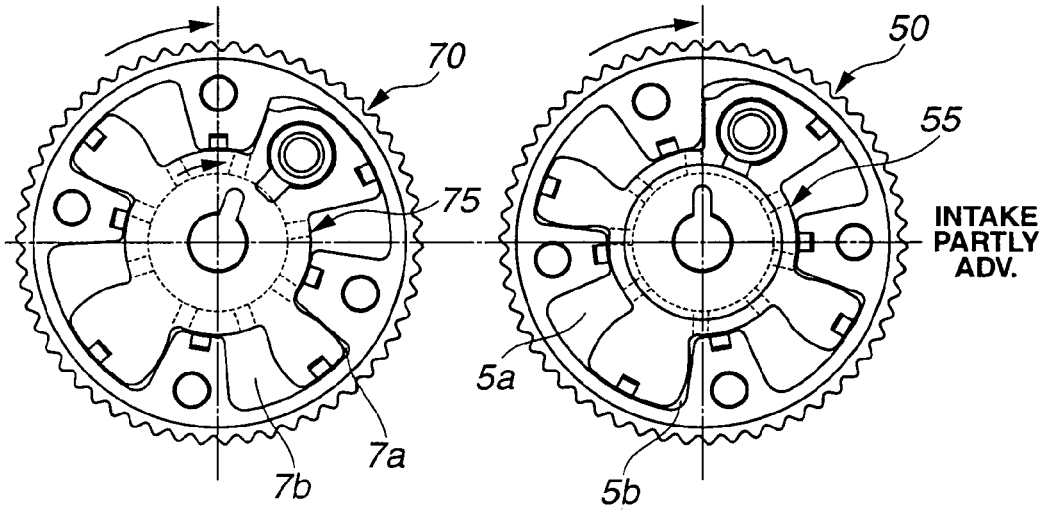
FIG. 13 is a sectional view showing the first and second valve timing control mechanisms of the valve timing control apparatus of FIG. 11, taken across line F12—F12 shown in FIG. 11, in a partly advanced state.
Figure 14:
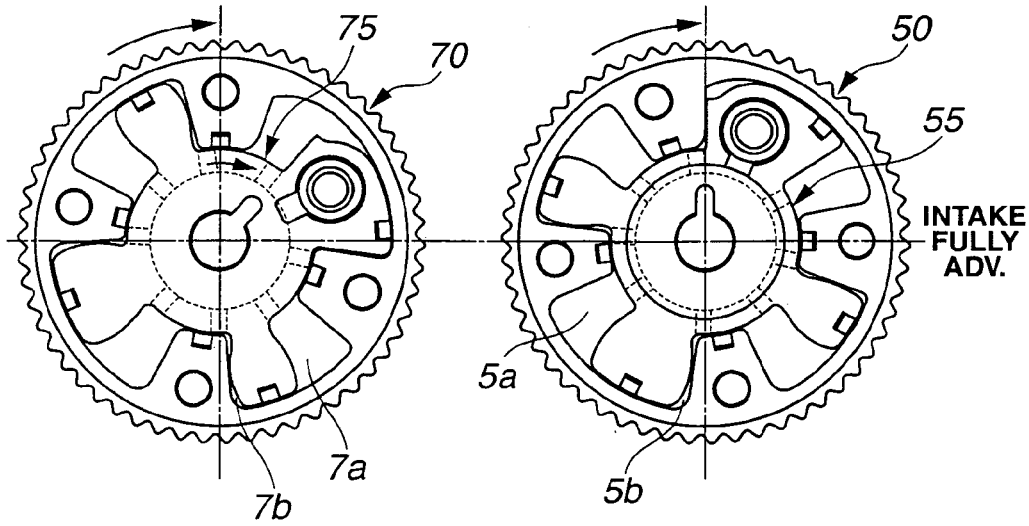
FIG. 14 is a sectional view showing the first and second valve timing control mechanisms of the valve timing control apparatus of FIG. 11, taken across line F12—F12 shown in FIG. 11, in the most advanced state.
Figure 15:
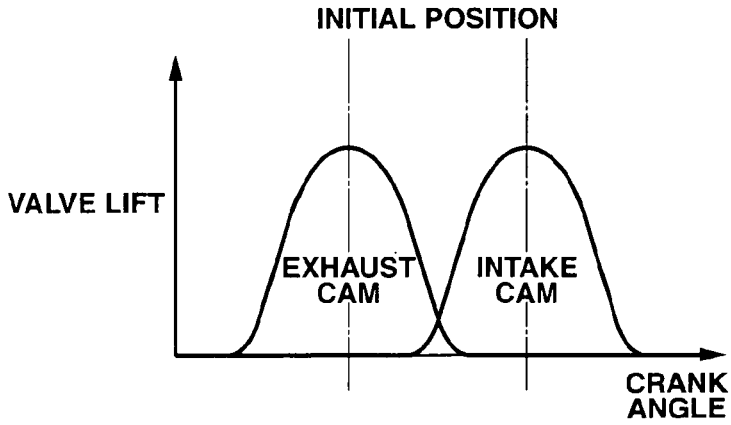
FIG. 15 is a diagram showing a relationship between the crank angle and valve lift in the engine start initial state in the valve timing control system shown in FIG. 11.

A SECOND EMBODIMENT of the present invention is shown in FIGS. 11–17. The basic construction is the same as that of the first embodiment. The different points are as follows: FIG. 11 is an axial sectional view showing the first and second VTC mechanisms 5 and 7 in the engine start initial state. FIG. 12 is a cross sectional view in the engine start initial state. FIG. 15 is a graph showing a relationship between the valve lift and crank angle in the engine start initial state. In the first embodiment, the initial position of the second VTC mechanism 7 is the most advanced position. In the second embodiment, by contrast, the initial position of second VTC mechanism 7 is the most retarded position. Therefore, the advance fluid passage 81 and the retard fluid passage 82 are arranged as shown in FIG. 13, differently from the arrangement of FIG. 2.

[Construction of second valve timing control mechanism] In the engine start state at the time of an engine starting operation, the second vane rotor 75 is locked at the most retarded position by the second lock pin 76 engaging in the second lock hole 73*b*, so that the second vane rotor 75 and second housing 70 rotate as a unit. However, when the operating oil is supplied to the second advance chambers 7*a* from oil pump 9, the oil pressure is applied to the second lock pin 76 against the spring, and the second lock pin 76 is disengaged from the second lock hole 73*b*. Therefore, the second vane rotor 75 rotates relative to second housing 70 in the advance direction and thereby produces the VTC operating angle. Similarly, when the operating oil is supplied to the second retard chambers 7*b*, the second vane rotor 75 rotates relative to second housing 70 in the retard direction and thereby produces the VTC operating angle.

In the first embodiment, the resilient members 7*c* are disposed in the second advance chambers 7*a*. However, in the second embodiment, there are provided no resilient members.

[Relation between crankshaft and camshafts] When the first and second VTC mechanism 5 and 7 are locked, respectively, by the first and second lock pins 56 and 76, the phases of exhaust camshaft 4 and intake camshaft 8 are determined with respect to the rotation of crankshaft 1 in the same manner as in the first embodiment. Moreover, the advance control and retard control are achieved in the same manner as in the first embodiment. Therefore, repetitive explanation is omitted.

In the second embodiment, both of the first and second VTC mechanism 5 and 7 are arranged to vary the phase of intake camshaft 8 with respect to the crankshaft rotation, as in the first embodiment. However, unlike the first embodiment, the system of the second embodiment is unable to perform the retard control from the initial position in the engine start state.

Figure 16:
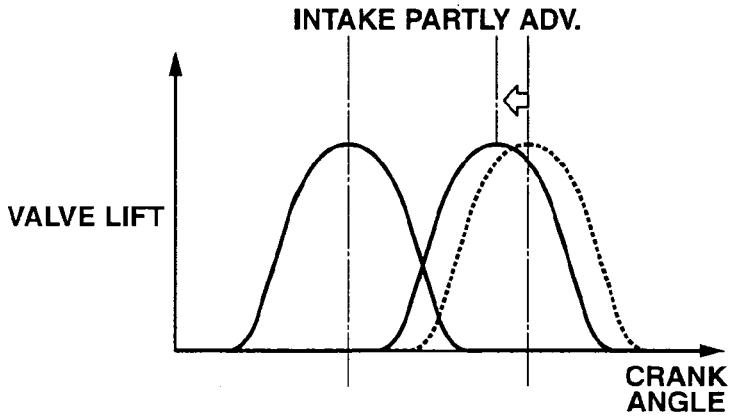
FIG. 16 is a diagram showing a relationship between the crank angle and valve lift in the second embodiment in the partly advanced state.

FIG. 13 shows the first and second VTC mechanism 5 and 7 when controlled to a partly advanced position only by first mechanism 5. FIG. 16 is a graph showing the relationship between the valve lift and crank angle in the case of the advance control only by first mechanism 5. When the intake camshaft 8 is controlled to a partly advanced position, the intake valves open earlier. As compared to the engine start state, each intake valve starts opening earlier before the closure of the exhaust valve, and hence the valve overlap of the intake and exhaust valves is increased.

Figure 17:
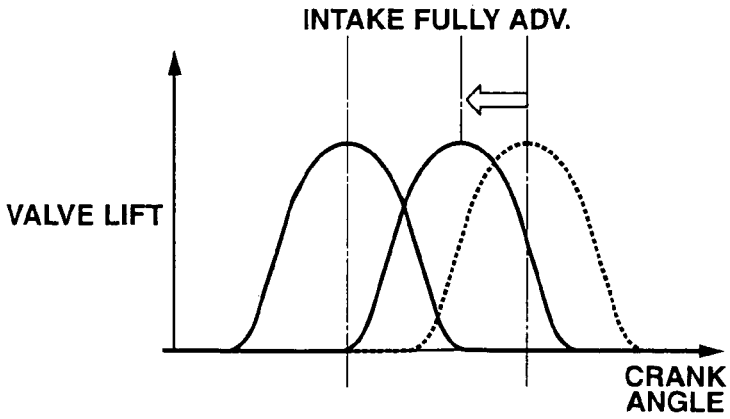
FIG. 17 is a diagram showing a relationship between the crank angle and valve lift in the second embodiment in the most advanced state.

FIG. 14 shows the first and second VTC mechanism 5 and 7 when controlled to the fully advanced position. The fully advanced state is achieved by controlling the first and second mechanism 5 and 7 to the respective most advanced positions. FIG. 17 is a graph showing the relationship between the valve lift and crank angle in the fully advanced state. When the intake camshaft 8 is controlled to the most advanced position, the valve overlap is further increased.

In the valve timing control system according to the second embodiment, the first VTC mechanism 7 is initially set at the most retarded position, and controlled from the initial position to achieve the advance control from the engine start state. The second VTC mechanism 7 is initially set at the most retarded position, and controlled to achieve the advance control from the engine start state. Therefore, the valve timing control system of the second embodiment can achieve the advance control to obtain a larger conversion angle from the initial state at the time of engine start.

[Relation between engine driving condition and valve timing control mechanisms] The first and second VTC mechanism 5 and 7 are operated in dependence on the engine driving condition in the following manner.

(When the system is restored to the initial state for engine start before a complete stop of the engine) When the engine is stopped, the valve timing control system normally restores the first and second VTC mechanisms, as a control end operation, to the engine start state in which the first and second lock pins 56 and 76 are engaged, respectively, in the first and second lock holes 53*b* and 73*b*. Therefore, the system can control the first and second mechanisms 5 and 7 from the initial engine start state irrespective of whether the oil pressure is available or not.

However, if the engine stalls before the control end operation to restore the first and second mechanisms 5 and 7 to the engine start state, the crankshaft stops after several revolutions due to the inertial force. In this case, even if the exhaust camshaft 4 receives an alternative torque, the influence is not problematical since exhaust camshaft 4 rotates as a unit with crankshaft 1.

On the other hand, an alternating torque acts on intake camshaft 8. Since the integral of the alternating torque with respect to the number of revolutions becomes positive, the positive torque is applied in the retarding direction on the second vane rotor 75 rotating as a unit with the intake camshaft 8 with respect to the rotating direction. In this case, the second vane rotor 75 and second housing 70 are moved toward the initial state, and the second VTC mechanism 7 is returned reliably to the initial position in the initial engine start state.

When the first housing 50 is positioned on the advance side with respect to first vane rotor 55 in first VTC mechanism 5, a positive torque acting on the second vane rotor 75 (intake camshaft 8) is transmitted through the second lock pin 76 to the second housing 70 in the second VTC mechanism 7 in the engine start initial state. Therefore, the first housing 50 is returned in the retard side by the second housing 70, and the first VTC mechanism 5 is restored to the most retarded position. Even if the second lock pin 76 is not correctly engaged, and hence the second mechanism 7 is not correctly in the engine start state, the positive torque is applied to second housing 70 from second vane rotor 75. Therefore, first housing 50 is returned in the retard direction, and the mechanism is returned to the most retarded position of the engine start state. Thus, the system can prevent fluttering between the vane rotor and housing at the time of engine restart operation, by holding the first and second mechanisms 5 and 7 in the initial engine start state by the lock pins 56 and 76.

(When the system is not restored to the initial state for engine start before a complete stop of the engine) When the engine stalls before the control end operation to restore the first and second mechanisms 5 and 7 to the engine start initial state, the system is not in the engine start state at the time of a next engine start operation. In this case, the first vane rotor 55 is rotated by crankshaft 1 in the engine restart operation. Even if the first vane rotor 55 and first housing 50 are separated, the first vane rotor 55 is moved to the position in the engine start state. Therefore the first lock pin 56 engages in the first lock hole 53*b*, and thereby prevents flapping between the first vane rotor 55 and first housing 50.

The rotation of first housing 50 is transmitted to second housing 70, and then the second housing 70 rotates toward the second vane rotor 75 and rotates the second vane rotor 75. Although the second vane rotor 75 receives an alternating torque as mentioned before, the second lock pin 76 reliably engages in the second lock hole 73*b* because the integral of the alternating torque becomes position after several revolutions being positive and the engagement of the lock pin 76 prevents fluttering between the second vane rotor 75 and second housing 70.

In the valve timing control system according to the second embodiment, the first and second VTC mechanism 5 and 7 are both set initially at the most retarded positions. Therefore, the system can achieve a wider phase variation range with a larger conversion angle by adding the first operating angle of the first mechanism 5 and the second operating angle of the second mechanism 7. Furthermore, the system is arranged to return to the initial state spontaneously by the alternating torque without the need for resilient members 7*c* of the first embodiment. Therefore, the construction can be simplified. The first and second VTC mechanisms 5 and 7 can be controlled by controller 10 in the same manner as in the first embodiment.

Figure 18:
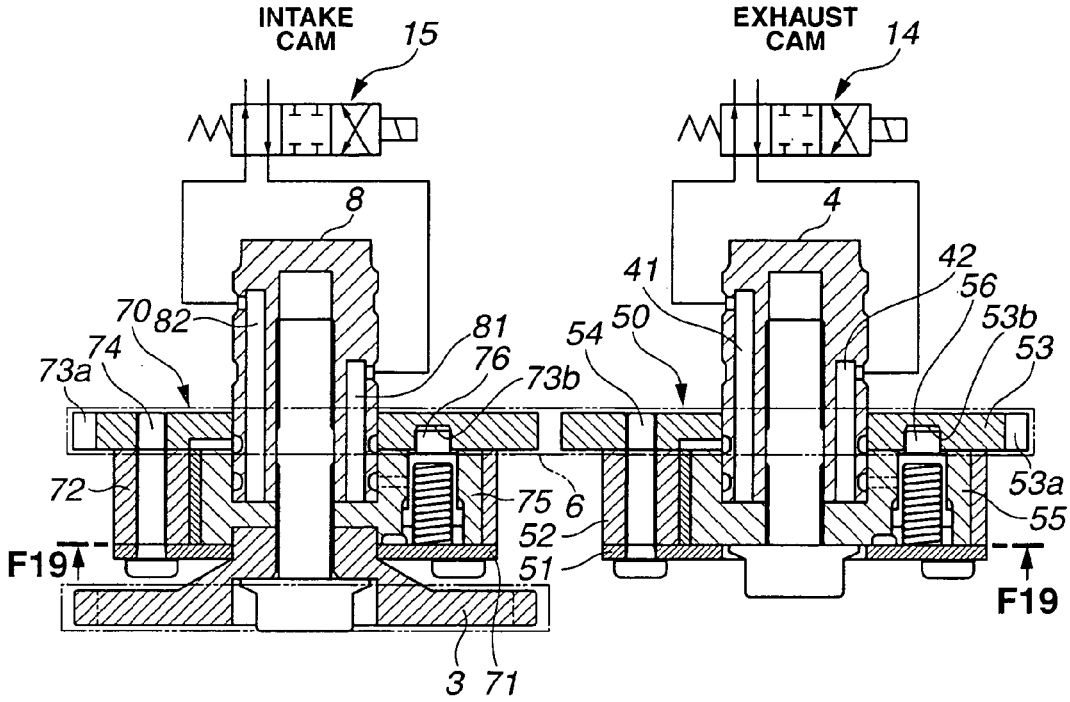
FIG. 18 is a sectional view showing first and second valve timing control mechanisms of a valve timing control apparatus according to a third embodiment in the engine start initial state, taken across a line F18—F18 shown in FIG. 19.

FIG. 18–24 show a valve timing control apparatus or system according to a THIRD EMBODIMENT of the present invention. The basic construction is the same as that of the first embodiment. The different points are as follows: In the first embodiment, the drive sprocket 3 is provided at an end of exhaust camshaft 4. In the third embodiment, as shown in FIG. 18, the drive sprocket 3 is provided at an end of intake camshaft 8. Therefore, the valve timing control system according to the third embodiment is arranged to control the phase of exhaust camshaft 4. Accordingly, there is provided an exhaust cam angle sensor 13 (similar to a sensor 13 shown in FIG. 34 and FIG. 37) for sensing the rotational angle of exhaust camshaft 4, instead of the intake cam angle sensor 12. The exhaust cam angle sensor 13 may be positioned near the second end of exhaust camshaft 4 remote from the VTC mechanism 5 attached to the first end of exhaust camshaft 4.

Figure 19:
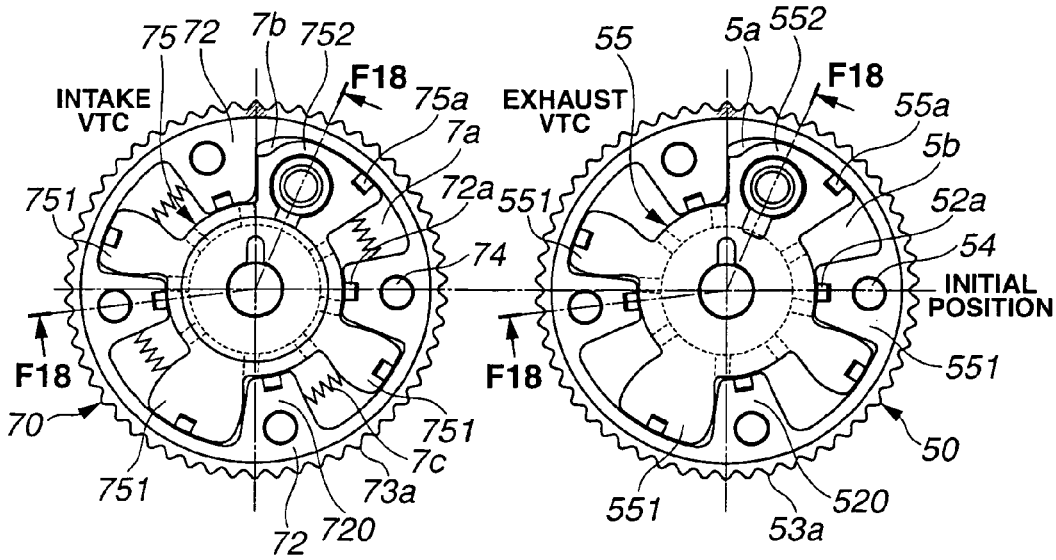
FIG. 19 is a sectional view showing the first and second valve timing control mechanisms in the engine start initial state, taken across a line F19—F19 shown in FIG. 18.
Figure 22:
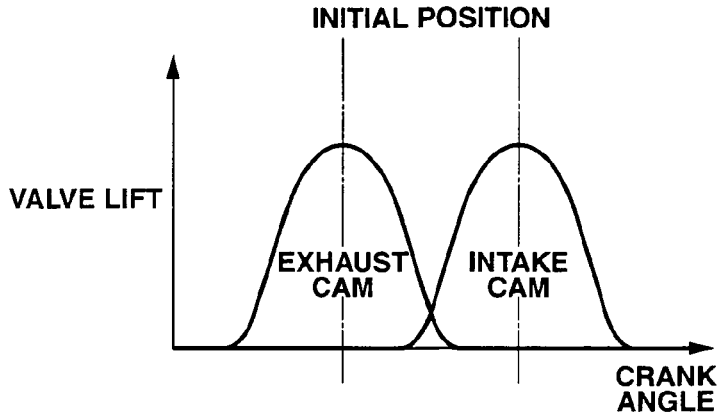
FIG. 22 is a diagram showing a relationship between the crank angle and valve lift in the engine start initial state in the valve timing control system shown in FIG. 18.

FIGS. 18 and 19 show first and second VTC mechanisms 5 and 7 in the initial state at the time of engine start operation in axial section and cross section. FIG. 18 is a sectional view taken across a line F18—F18 shown in FIG. 19; and FIG. 19 is a sectional view taken across a line F19—F19 shown in FIG. 18. FIG. 22 is a valve timing linear diagram showing a relationship between the valve lift and crank angle at the time of engine start operation.

[Construction of first valve timing control mechanism] The first VTC mechanism 5 shown in FIGS. 18 and 19 is substantially identical to the mechanism 5 shown in FIGS. 2 and 3, except that the first VTC mechanism 5 of FIGS. 18 and 19 is not provided with the drive sprocket 3.

In the engine start initial state, the first lock pin 56 is engaged in the first lock hole 53*b*, and hence the first vane rotor 55 is locked at the most retarded position in the first housing 50 so that first vane rotor 55 and first housing 50 rotate as a unit. When first lock pin 56 is disengaged from first lock hole 53*b* by the supply of oil pressure into the first advance chambers 5*a*, the first vane rotor 55 rotates relative to first housing 50 in the advance direction and thereby produces the operating angle. Similarly, when the oil pressure is supplied into the first retard chambers 5*b*, the first vane rotor 55 rotates relative to first housing 50 in the retard direction and thereby produces the operating angle.

[Construction of second valve timing control mechanism] The second VTC mechanism 7 shown in FIGS. 18 and 19 is substantially identical to the mechanism 7 shown in FIGS. 2 and 3, except that the second VTC mechanism 5 of FIGS. 18 and 19 is provided with the drive sprocket 3.

In the engine start operation, the second housing 70 is locked at the most advanced position by the second lock pin 76, so that the second housing 70 and second vane rotor 75 rotate as a unit. When second lock pin 76 is disengaged from second lock hole 73*b* by the supply of oil pressure into the second retard chambers 7*b*, the second housing 70 rotates relative to the second vane rotor 75 in the retard direction and thereby produces the operating angle. Similarly, when the oil pressure is supplied to the second advance chambers 7*a*, the second housing 70 rotates relative to the second vane rotor 75 in the advance direction and thereby produces the operating angle.

Resilient member 7*c* in the form of a coil spring is disposed in each of the second advance chambers 7*a*, as shown in FIG. 19. Each resilient member 7*c* is disposed between the second housing member 72 (one of the inward projections 720) and the second vane rotor 75. By the resilient members 7*c*, the second housing 70 is urged in the advance direction with respect to the second vane rotor 75. Therefore, the second housing 70 returns to the most retarded position in the initial state by the alternating torque.

[Relation between crankshaft and camshafts] The valve timing control system according to the third embodiment determines the phases of exhaust camshaft 4 and intake camshaft 8 with respect to the rotation of crankshaft 1 in the following manner. When the crankshaft 1 rotates, the drive sprocket 3 is rotated through chain 2. The intake camshaft 8 is fixed to, and integral with, drive sprocket 3. Therefore, in this example, the phase of intake camshaft 8 is invariable with respect to crankshaft 1.

When intake camshaft 8 rotates, the second vane rotor 75 rotates as a unit with intake camshaft 8. In the engine start state of the most advanced position, the rotation of second vane rotor 75 is transmitted directly to second housing 70 by the second lock pin 76. When, on the other hand, second vane rotor 75 is out of the most advanced position, the rotation is transmitted through the oil in second advance chambers 7*a* from second vane rotor 75 to second housing 70.

The rotation of second housing 70 is transmitted synchronously to first housing 50 by chain 6 between second and first sprockets 73*a* and 53*a*. In the engine start state of the most retarded position, the rotation of first housing 50 is transmitted directly to first vane rotor 55 by the first lock pin 56, and further to the exhaust camshaft 4 fixed with first vane rotor 55. When, on the other hand, first vane rotor 55 is out of the most retarded position, the rotation is transmitted through the oil in first advance chambers 5*a* from first housing 50 to first vane rotor 55.

(Valve timing control only by the first valve timing control mechanism) The valve timing control system according to the third embodiment is operated in the following manner when the valve timing control is performed only by the first VTC mechanism 5. Advance Control: In the case of the advance control of first VTC mechanism 5, the fluid pressure is supplied to first advance chambers 5*a* shown in FIG. 19, and the phase of first vane rotor 55 is shifted in the advance direction to produce the operation angle in the advance direction. In other words, the intake camshaft 8 rotates in phase with crankshaft 1 whereas the phase of exhaust camshaft 4 is advanced by the amount of the operation angle of first VTC mechanism 5. Thus, the valve timing control system produces the conversion angle to shift the phase of exhaust camshaft 4 in the advance direction by the amount determined by the first VTC mechanism 5. Retard Control: In the case of the retard control of first VTC mechanism 5, the fluid pressure is supplied to first retard chambers 5*b*, and the phase of first vane rotor 55 is shifted in the retard direction so as to produce the operation angle in the retard direction. In other words, the intake camshaft 8 rotates in phase with crankshaft 1 whereas the phase of exhaust camshaft 4 is retarded by the amount of the operation angle of first VTC mechanism 5. Thus, exhaust camshaft 4 receives the conversion angle to shift the phase in the retard direction by the amount determined by the first VTC mechanism 5.

(Valve timing control only by the second valve timing control mechanism) The valve timing control system is operated in the following manner when the valve timing control is performed only by the second VTC mechanism 7. Advance Control: In the case of the advance control of second VTC mechanism 7, the fluid pressure is supplied to second advance chambers 7*a*, and the phase of second housing 70 is shifted in the advance direction to produce the operation angle in the advance direction. In other words, the intake camshaft 8 rotates in phase with crankshaft 1, and the phase of exhaust camshaft 4 is advanced, together with second housing 70 and first housing 50 by the amount of the operation angle of second VTC mechanism 7. Thus, exhaust camshaft 4 obtains the conversion angle to shift the phase in the advance direction by the amount determined by the second VTC mechanism 7. Retard Control: In the case of the retard control of second VTC mechanism 7, the fluid pressure is supplied to second retard chambers 7*b*, and the phase of the second housing 70 is shifted in the retard direction so as to produce the operation angle in the retard direction. In other words, the intake camshaft 8 rotates in phase with crankshaft 1 whereas the phase of exhaust camshaft 4 is retarded, together with the second housing 70 and the first housing 50, by the amount of the operation angle of second VTC mechanism 7. Thus, exhaust camshaft 4 receives the conversion angle to shift the phase in the retard direction by the amount determined by the second VTC mechanism 7.

Thus, in the valve timing control system according to the third embodiment, the first and second VTC mechanisms 5 and 7 are both arranged to shift the phase of exhaust camshaft 4 with respect to crankshaft 1. The phase of exhaust camshaft 4 with respect to crankshaft is shifted by the conversion angle which is equal to the sum of the operation angle of first VTC mechanism 5 and the operation angle of second VTC mechanism 7.

Figure 20:
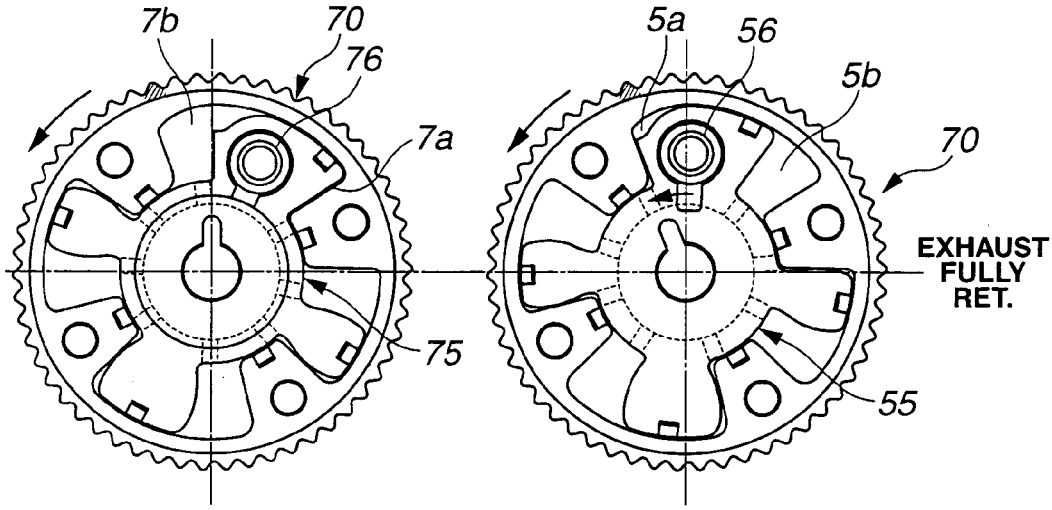
FIG. 20 is a sectional view showing the first and second valve timing control mechanisms of the valve timing control apparatus of FIG. 19, taken across line 19-F19 shown in FIG. 18, in the most retarded state.
Figure 23:
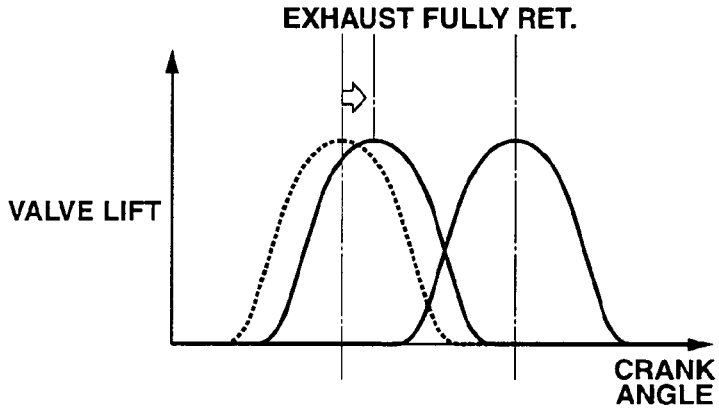
FIG. 23 is a diagram showing a relationship between the crank angle and valve lift in the third embodiment in the most retarded state.

FIG. 20 shows the first and second VTC mechanisms 5 and 7 in the fully retarded state in which the most retarded position is reached from the engine start state. The fully retarded position is attained by controlling only the second VTC mechanism 7 to the most retarded position. FIG. 23 shows the relationships of valve lifts of intake and exhaust valves and the crank angle in the fully retarded position. When exhaust camshaft 4 is controlled to the fully retarded position, the exhaust valve opens later. As compared to the engine start initial state, the exhaust valve closes later after the opening of the intake valve, and hence the valve overlap is increased.

Figure 21:
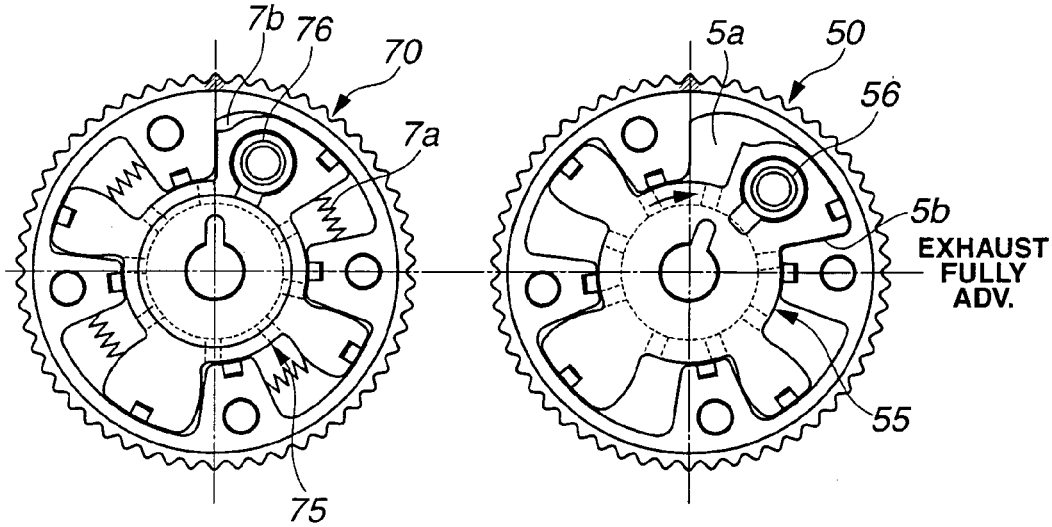
FIG. 21 is a sectional view showing the first and second valve timing control mechanisms of the valve timing control apparatus of FIG. 19, taken across line F19—F19 shown in FIG. 18, in the most advanced state.
Figure 24:
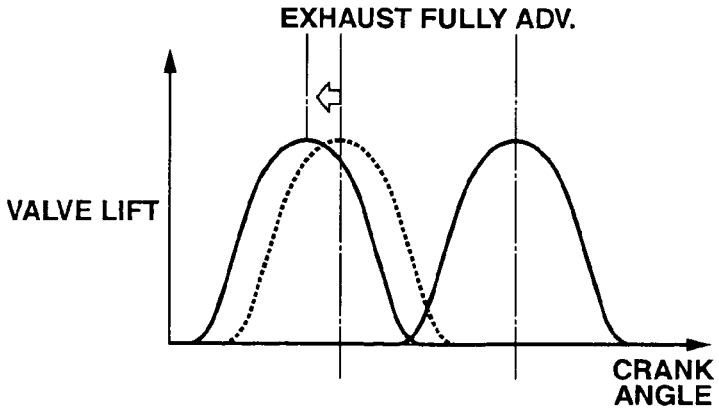
FIG. 24 is a diagram showing a relationship between the crank angle and valve lift in the third embodiment in the most advanced state.

FIG. 21 shows the first and second VTC mechanisms 5 and 7 of the third embodiment in the fully advanced state in which the most advanced position is reached from the engine start state. The fully advanced position is attained by controlling only the first VTC mechanism 5 to the most advanced position. FIG. 24 shows the relationships of valve lifts of intake and exhaust valves and the crank angle in the fully advanced state. When exhaust camshaft 4 is controlled to the fully advanced position, the exhaust valve opens earlier. As compared to the engine start state, the exhaust valve closes earlier with respect to the opening of the intake valve, and hence the valve overlap is decreased.

In this way, the first VTC mechanism 5 is set at the most retarded position at the time of engine starting, and controlled from the most retarded position to achieve the advance control. On the other hand, the second VTC mechanism 7 is set at the most advanced position at the time of engine starting, and controlled from the most advanced position to achieve the retard control. With the first and second timing control mechanisms 5 and 7, this valve timing control system can perform both the advance control and retard control from the initial state of engine start.

[Relation between engine driving condition and valve timing control mechanisms] The first and second VTC mechanism 5 and 7 in the third embodiment are operated in dependence on the engine driving condition in the following manner.

(When the system is restored to the initial state for engine start before a complete stop of the engine) When the engine is stopped, the valve timing control system normally restores, as the control end operation, the first and second VTC mechanisms to the engine start initial state in which the first and second lock pins 56 and 76 are engaged, respectively, in the first and second lock holes 53*b* and 73*b*. Therefore, the system can control the first and second mechanisms 5 and 7 from the initial engine start state irrespective of whether the oil pressure is available or not, and hence prevent flapping between the vane housing and housing by the alternating torque at the time of engine restart operation.

However, if the engine stalls before the control end operation to restore the first and second mechanisms 5 and 7 to the engine start initial state, the crankshaft stops after several revolutions due to the inertial force. In this case, even if the intake camshaft 8 receives an alternative torque, the influence is not problematical since intake camshaft 8 rotates as a unit with crankshaft 1.

On the other hand, the alternating torque acts on exhaust camshaft 4. Since the integral of the alternating torque with respect to the number of revolutions becomes positive, the positive torque is applied in the retarding direction with respect to the rotational direction, on the first vane rotor 55 rotating as a unit with the exhaust camshaft 4. In this case, the initial position is the most retarded position, and hence the first vane rotor 55 is moved in the retard direction and returned to the most retarded position, reliably.

When the second housing 70 is positioned on the retard side with respect to second vane rotor 75 in second VTC mechanism 7, a positive torque acting on the first vane rotor 55 (exhaust camshaft 4) is transmitted through the first lock pin 56 to the first housing 50 in the first VTC mechanism 5 in the engine start state of the most retarded position. Therefore, the first housing 50 tries to turn the second housing 70 to the retard side. In this case, the resilient members 7*c* urge the second housing 70 in the advance direction with respect to the second vane rotor 75, and return the second mechanism 7 reliably to the engine start initial position.

When, by the inertia, the crankshaft 1 stops after several revolutions, the rotational speed of the second vane rotor 75 connected with crankshaft 1 by chain 1 decreases relatively quickly since the crankshaft 1 receives piston resistance etc. These rotating elements are grouped into a first rotating element group. Then, the second housing 70 and first housing 50 are connected by chain 6. These rotating elements are grouped into a second rotating element group. These rotating elements of the second group can rotate freely relatively within an operating angle range, despite the involvement of slight sliding resistance when the lock pins are not engaged. Therefore, each rotating element of the second group rotates by its own inertia. The exhaust camshaft 4 is rotatable in the unlocked state in which the lock pin is not engaged. However, exhaust camshaft 4 does not rotate so much because the alternating torque is applied to exhaust camshaft 4. This rotating element is grouped into a third rotating element group.

When the engine is stopped, and crankshaft 1 rotates through an angular distance of several revolutions by the inertia, the rotational speeds of the first and third rotating element groups become lower than the speed of the second group. Therefore, the second group catches up with the first and third groups during the several revolutions, and the engine start initial state is reached without the aid of the resilient members 7*c*. In this way, the system according to the third embodiment can restore to the initial state reliably.

(When the system is not restored to the initial state for engine start before a complete stop of the engine) When the engine stalls before the control end operation to restore the first and second mechanisms 5 and 7 to the engine start state, the system is not in the engine start state at the time of a next engine start operation. In this case, the second vane rotor 75 is rotated by crankshaft 1 in the engine restart operation. In this case, the rotation of second vane rotor 75 is transmitted through resilient members 7*c* to the second housing 70.

Then, the rotation of second housing 70 is transmitted to the first housing 50. The first housing 50 moves in the direction to move the first vane rotor 55 to the retard side, and hence returns to the initial position. Therefore, the first lock pin 56 engages in the first lock hole 53*b*, and thereby prevents fluttering between the first vane rotor 55 and first housing 50.

In the second VTC mechanism 7, the second housing 70 is urged by resilient member 7*c* in the advance direction. Therefore, second housing 70 moves in the advance direction with respect to the second vane rotor 75, and returns to the initial position. At the initial position, the second lock pin 76 engages in the second lock hole 73*b* and thereby prevents flapping between second vane rotor 75 and second housing 70.

When second VTC mechanism 7 is not restored to its initial position, and only the first VTC mechanism 5 is restored to its initial position, alternating torque of exhaust camshaft 4 is applied to the second housing 70 so as to urge second housing 70 in the retard direction away from the initial position. Therefore, the load of the resilient members 7*c* is preferably set to such a value as to offset the alternating torque to the negative side.

The valve timing control system of the third embodiment can be controlled in the same manner as in the first embodiment.

Figure 25:
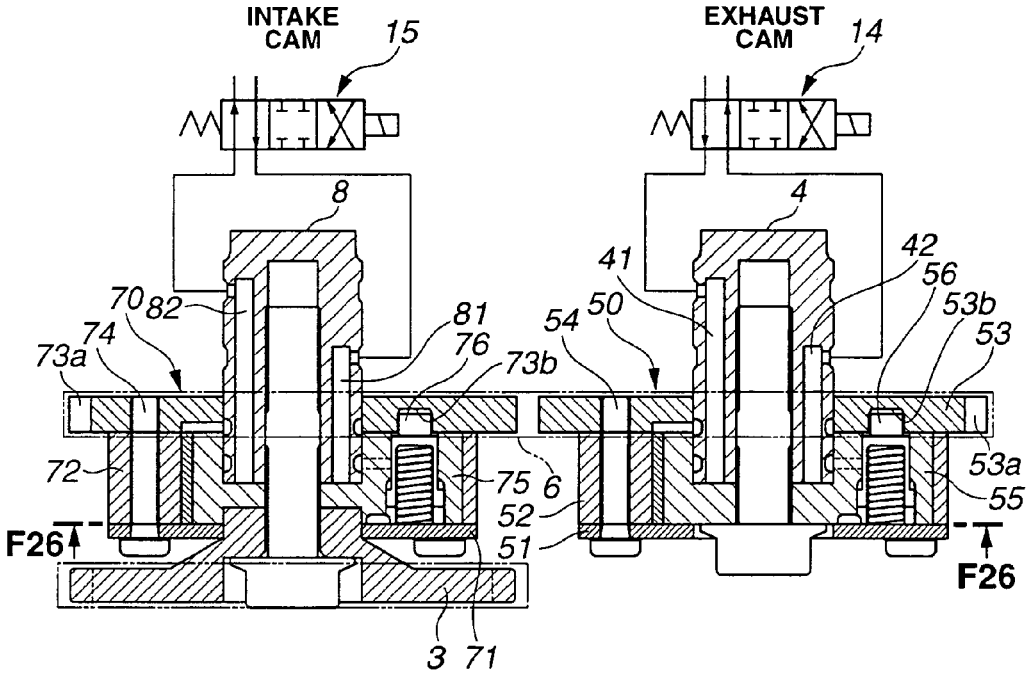
FIG. 25 is a sectional view showing first and second valve timing control mechanisms of a valve timing control apparatus according to a fourth embodiment in the engine start initial state, taken across a line F25—F25 shown in FIG. 26.
Figure 26:
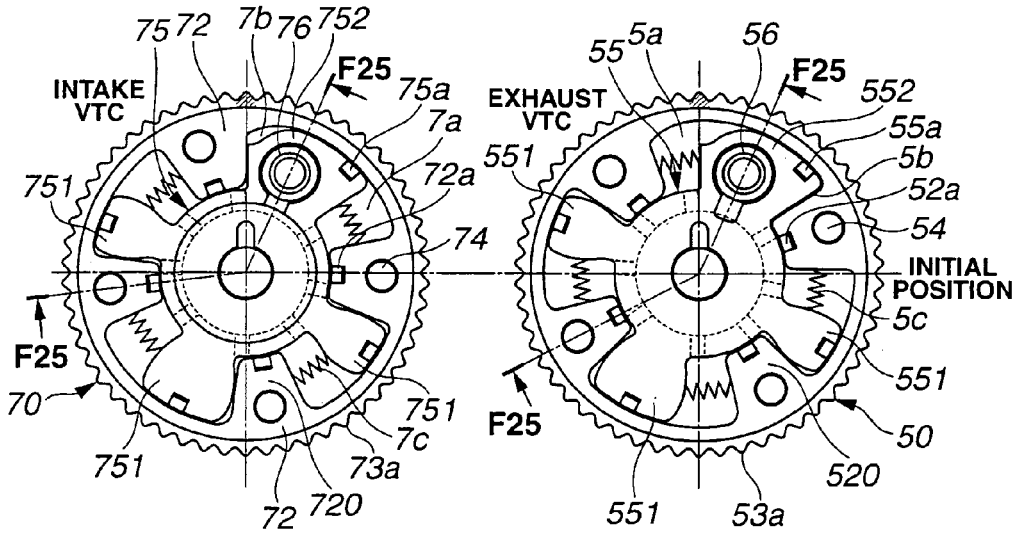
FIG. 26 is a sectional view showing the first and second valve timing control mechanisms in the engine start initial state, taken across a line F26—F26 shown in FIG. 25.
Figure 27:
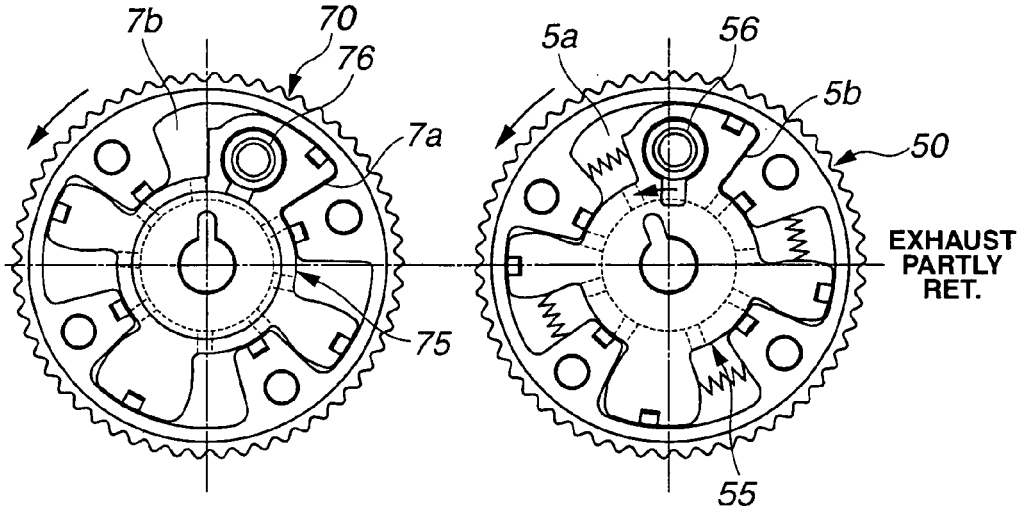
FIG. 27 is a sectional view showing the first and second valve timing control mechanisms of the valve timing control apparatus of FIG. 25, taken across line F26—F26 shown in FIG. 25, in the partly retarded state.
Figure 28:
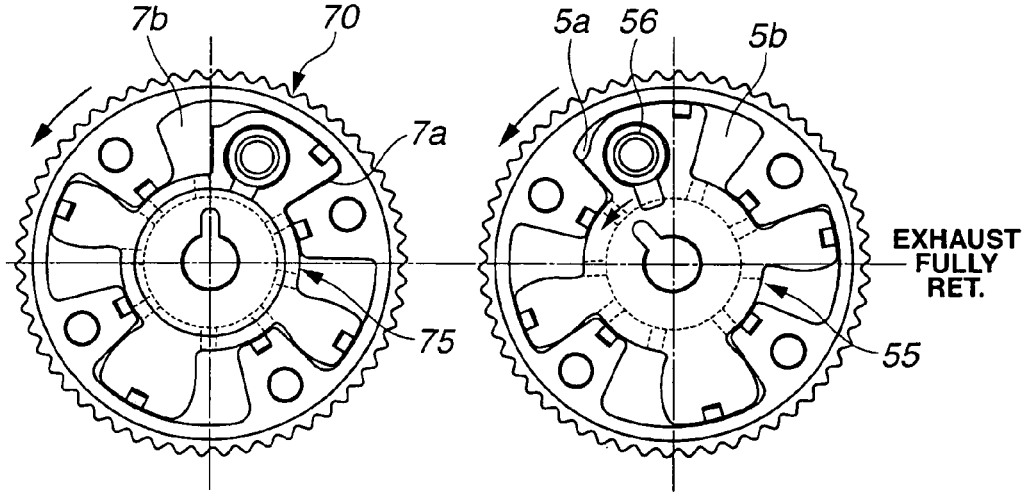
FIG. 28 is a sectional view showing the first and second valve timing control mechanisms of the valve timing control apparatus of FIG. 25, taken across line F26—F26 shown in FIG. 25, in the partly retarded state, in the most retarded state.
Figure 29:
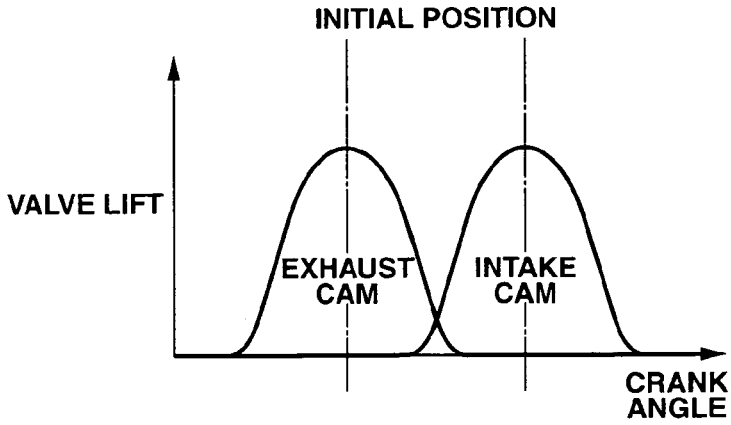
FIG. 29 is a diagram showing a relationship between the crank angle and valve lift in the engine start initial state in the valve timing control system shown in FIG. 25.

A FORTH EMBODIMENT is shown in FIGS. 25–31. The basic construction is the same as that of the third embodiment. The different points are as follows: FIG. 25 is an axial sectional view showing the first and second VTC mechanisms 5 and 7 in the engine start state. FIG. 26 is a cross sectional view in the engine start state. FIG. 29 is a graph showing a relationship between the valve lift and crank angle in the engine start initial state. In the third embodiment, the initial position of first VTC mechanism 5 is the most retarded position. In the fourth embodiment, by contrast, the initial position of first VTC mechanism 5 is the most advanced position. Therefore, the advance fluid passage 41 and retard fluid passage 42 are arranged as shown in FIG. 25, differently from the arrangement of FIG. 18.

[Construction of first valve timing control mechanism] In the engine start initial state, the first vane rotor 55 of the fourth embodiment is locked at the most advanced position by the first lock pin 56 engaging in the first lock hole 53*b*, so that the first vane rotor 55 and first housing 50 rotate as a unit. However, when the operating oil is supplied to the first advance chambers 5*a* from oil pump 9, the first lock pin 56 is disengaged from the first lock hole 53*b* by the application of the oil pressure against the spring, and the first vane rotor 55 rotates relative to the first housing 50 to produce an operating angle in the advance direction. When the operating oil is supplied to the first retard chambers 5*b*, the first vane rotor 55 rotates relative to the first housing 50 in the retard direction to produce an operating angle in the retard direction.

In the third embodiment, the resilient members 7*c* are disposed only in the second advance chambers 7*a*. However, in the fourth embodiment, resilient members 5*c* are disposed, respectively, in the first advance chambers 5*a*, too, as shown in FIG. 26.

[Relation between crankshaft and camshafts] When the first and second valve timing controlled mechanism 5 and 7 are locked, respectively, by the first and second lock pins 56 and 76, the phases of exhaust camshaft 4 and intake camshaft 8 in the fourth embodiment are determined with respect to the rotation of crankshaft 1 in the same manner as in the third embodiment. Moreover, the advance control and retard control are achieved in the same manner as in the third embodiment. Therefore, repetitive explanation is omitted.

In the fourth embodiment, both of the first and second VTC mechanism 5 and 7 are arranged to vary the phase of exhaust camshaft 4 with respect to the crankshaft rotation, as in the third embodiment. However, unlike the third embodiment, the system of the fourth embodiment is unable to perform the advance control from the initial position in the engine start state.

Figure 30:
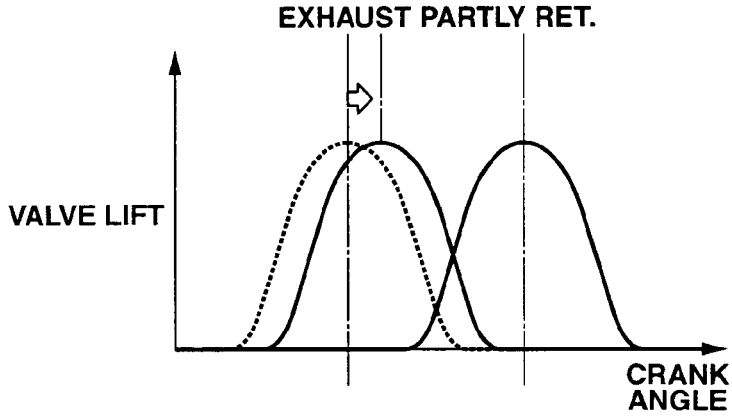
FIG. 30 is a diagram showing a relationship between the crank angle and valve lift in the fourth embodiment in the partly retarded state.

FIG. 27 shows the first and second VTC mechanism 5 and 7 when controlled to a partly retarded position only by first VTC mechanism 5. FIG. 30 is a graph showing the relationship between the valve lift and crank angle in the case of the retard control only by first VTC mechanism 5. When the exhaust camshaft 4 is controlled to the partly retarded position, the exhaust valve open later. As compared to the engine start initial state, the exhaust valve closes later after the opening of the intake valve, and hence the valve overlap is increased.

Figure 31:
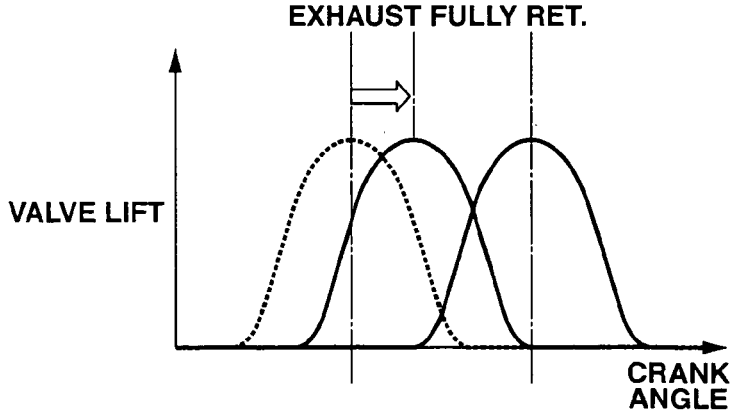
FIG. 31 is a diagram showing a relationship between the crank angle and valve lift in the fourth embodiment in the most retarded state.

FIG. 28 shows the first and second VTC mechanism 5 and 7 when controlled from the initial position to the fully retarded position. The fully retarded state is achieved by controlling the first and second mechanism 5 and 7 to the respective most retarded positions. FIG. 31 is a diagram showing the relationship between the valve lift and crank angle in the fully retarded state. When the exhaust camshaft 4 is controlled to the most retarded position, the valve overlap is further increased.

In the valve timing control system according to the fourth embodiment, the first VTC mechanism 5 is initially set at the most advanced position, and controlled from the initial position to achieve the retard control. The second VTC mechanism 7 is initially set at the most advanced position, and controlled to achieve the retard control from the engine start state. Therefore, the valve timing control system of the fourth embodiment can achieve the retard control to obtain a larger conversion angle from the initial state at the time of engine start.

[Relation between engine driving condition and VTC mechanisms] The first and second VTC mechanism 5 and 7 are operated in dependence on the engine driving condition in the following manner.

(When the system is restored to the initial state for engine start before a complete stop of the engine) When the engine is stopped, the valve timing control system normally restores the first and second VTC mechanisms, as the control end operation, to the engine start state in which the first and second lock pins 56 and 76 are engaged, respectively, in the first and second lock holes 53*b* and 73*b*. Therefore, the system can control the first and second mechanisms 5 and 7 from the initial engine start state irrespective of whether the oil pressure is available or not, at the time of engine restart operation.

However, if the engine stalls before an end of the control end operation to restore the first and second mechanisms 5 and 7 to the engine start state, the crankshaft stops after several revolutions due to the inertial force. In this case, even if the intake camshaft 8 receives an alternative torque, the influence is not problematical since intake camshaft 8 rotates as a unit with crankshaft 1.

On the other hand, an alternating torque acts on exhaust camshaft 4. Since the integral of the alternating torque with respect to the number of revolutions becomes positive, the positive torque is applied in the retarding direction on the first vane rotor 55 rotating as a unit with exhaust camshaft 4 with respect to the rotating direction. In this case, the first mechanism 5 is moved by the forces of resilient members 5*c* disposed between first vane rotor 55 and first housing 50, toward the initial state, and the first mechanism 5 is returned reliably to the most retarded position in the initial engine start state.

When the second housing 70 is positioned on the retard side with respect to second vane rotor 75 in second VTC mechanism 7, a positive torque acting on the first vane rotor 55 (exhaust camshaft 4) is transmitted through the first lock pin 56 to the first housing 50 in the first VTC mechanism 5 at the most retarded position of the engine start initial state. Therefore, the second housing 70 receives a torque to try to rotate in the retard direction, from first housing 50. In this case, the second mechanism 7 is returned to the initial position by the force of resilient members 7*c* disposed between second housing 70 and second vane rotor 75. Thus, the system can prevent flapping between the vane rotor and housing at the time of engine restart operation, by holding the first and second mechanisms 5 and 7 in the initial engine start state by the lock pins 56 and 76.

(When the system is not restored to the initial state for engine start before a complete stop of the engine) When the engine stalls before the control end operation to restore the first and second mechanisms 5 and 7 to the engine start initial state, the system is not in the engine start state at the time of a next engine start operation. In this case, the second vane rotor 75 is rotated by crankshaft 1 in the engine restart operation. Even if the second vane rotor 75 and second housing 70 are disengaged, the second vane rotor 75 is moved to the position in the engine start state by the forces of resilient members 7*c*. Therefore the second lock pin 76 engages in the second lock hole 73*b*, and thereby prevents flapping between the second vane rotor 75 and second housing 70.

The rotation of second housing 70 is transmitted to first housing 50, and the first housing 50 urges first vane rotor 55 toward the initial position by the forces of resilient members 5*c*. Therefore, first lock pin 56 engages in first lock hole 53*b* reliably, and prevents flapping between first vane rotor 55 and first housing 50.

In the valve timing control system according to the fourth embodiment, the first and second VTC mechanism 5 and 7 are both set initially at the most advanced positions. Therefore, the system can achieve a wider phase variation range with a larger conversion angle by adding first VTC operating angle of the first mechanism 5 and the second VTC operating angle of the second mechanism 7. Furthermore, the system is arranged to return to the initial state with the simple construction including resilient members 5*c* and 7*c*. The first and second VTC mechanisms 5 and 7 can be controlled by controller 10 in the same manner as in the first embodiment.

Figure 32:
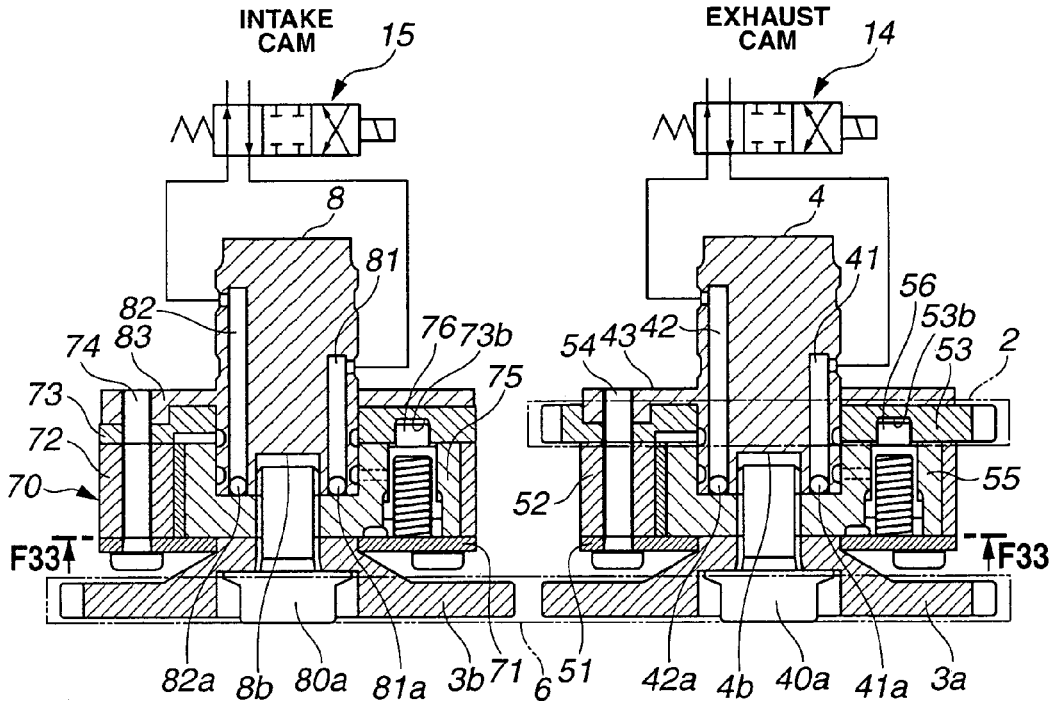
FIG. 32 is a sectional view showing first and second valve timing control mechanisms of a valve timing control apparatus according to a fifth embodiment in the engine start initial state, taken across a line F32—F32 shown in FIG. 33.
Figure 33:
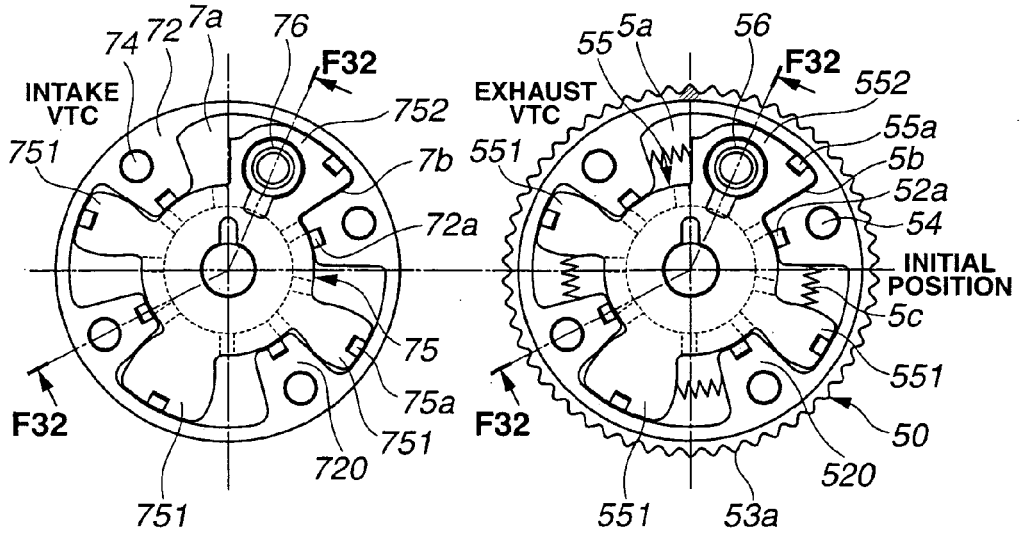
FIG. 33 is a sectional view showing the first and second valve timing control mechanisms in the engine start initial state, taken across a line F33—F33 shown in FIG. 32.

FIGS. 32 and 33 show a valve timing control apparatus or system according to a FIFTH EMBODIMENT of the present invention. The basic construction is the same as those of the preceding embodiments. FIG. 32 is an axial sectional view showing the first and second VTC mechanisms 5 and 7 in the engine start initial state. FIG. 33 is a cross sectional view in the engine start initial state. In the preceding embodiments, the rotation of crankshaft 1 is inputted to first vane rotor 55 or to second vane rotor 75. By contrast, in the fifth embodiment, the crankshaft rotation is inputted to first housing 50. In the fifth embodiment, first housing 50 serves as a first input member of the first VTC mechanism, and first vane rotor 55 serves as a first output member of the first VTC mechanism.

[Construction of first valve timing control mechanism] First VTC mechanism 5 includes four operating chambers formed in first housing 50 and four of vanes 551, 552 formed in first vane rotor 55. Each operating chamber is divided into first advance chamber 5*a* and first retard chamber 5*b* by a corresponding one of the vanes 551, 552. Each of the advance chambers 5*a* is connected with the advance, fluid passage 41; and each of the retard chambers 5*b* is connected with the retard fluid passage 42. Under the control of controller 10, first hydraulic control device 14 is actuated to control the supply and drainage of the operating oil selectively to and from the advance and retard chambers 5*a* and 5*b* through advance and retard passages 41 and 42.

Exhaust camshaft 4 is formed integrally with an outward flange 43 near the end of exhaust camshaft 4 as shown in FIG. 32. The first rear member or plate 53 of first housing 50 is formed with a drive sprocket 53*a* on the outer circumference. The first rear member 53 formed with drive sprocket 53*a* is fixed to the outward flange 43 of exhaust camshaft 4. Thus, first housing 50 is fixed to exhaust camshaft 4.

First housing 50 in the fifth embodiment includes a first front member (or plate) 51, a first housing member 52 and the above-mentioned first rear member (or plate) 53 which are joined together, into the integral first housing 50, by a plurality (four) of axially extending fastening bolts 54. First housing member 52 is sandwiched axially between first front and rear members 51 and 53. First front member 51 is in the form of a relatively thin circular disk. First housing member 52 encloses first vane rotor 55. First rear plate 53 is in the form of a plate, and first rear plate 53 is thicker than first front plate 51. First rear plate 53 is formed integrally with the above-mentioned drive sprocket 53*a*. First front plate 51 is clamped between the heads of bolts 54 and first housing member 52. First housing 50 is fixed to outward flange 43 of exhaust camshaft 4 by bolts 54. The first vane rotor 55 is constructed in the same manner as in the preceding embodiments.

In exhaust camshaft 4, there are formed advance fluid passage 41 and retard fluid passage 42 extending into exhaust camshaft 4 from the end of exhaust camshaft 4. Balls 41*a* and 42*a* are provided, respectively, at the axial ends of advance and retard fluid passages 41 and 42, so as to close the respective passage ends. These balls 41*a* and 42*a* are arranged to separate the advance and retard fluid passages from each other liquidtightly even when exhaust camshaft 4 and first vane rotor 55 rotate relative to each other. Moreover, the exhaust camshaft 4 of the fifth embodiment includes a bearing hole 4*b* formed at the center in the end of exhaust camshaft 4.

A first transmission sprocket 3*a* is fixed to first vane rotor 55 by a cam bolt 40*a*. The forward end of cam bolt 40*a* is received in the bearing hole 4*b* of exhaust camshaft 4, and supported rotatably by exhaust camshaft 4.

First VTC mechanism 5 of the fifth embodiment includes resilient members 5*c* disposed, respectively, in first advance chambers 5*a*, and arranged to urge first vane rotor 55 in the advance direction. First VTC mechanism 5 of the fifth embodiment is initially set at the most advanced position in the engine start state.

[Construction of second valve timing control mechanism] Second VTC mechanism 7 includes second housing 70 rotating as a unit with intake camshaft 8, and second vane rotor 75 rotatable relative to intake camshaft 8, in second housing 70.

Intake camshaft 8 is formed integrally with an outward flange 83 near the end of intake camshaft 8 as shown in FIG. 32. A second rear member or plate 73 of the second housing 70 is fixed to the outward flange 83 of intake camshaft 8. Thus, second housing 70 is fixed to intake camshaft 8.

Second housing 70 in the fifth embodiment includes a second front member (or plate) 71, a second housing member 72 and the above-mentioned second rear member (or plate) 73 which are joined together, into the integral second housing 70, by a plurality (four) of axially extending fastening bolts 74. Second housing member 72 is sandwiched axially between second front and rear members 71 and 73. Second front member 71 is in the form of a relatively thin circular disk. Second housing member 72 encloses second vane rotor 75. Second rear plate 73 is in the form of a plate, and second rear plate 73 is thicker than second front plate 71. Second housing 70 is fixed to outward flange 83 of intake camshaft 8 by bolts 74. The second vane rotor 75 is constructed in the same manner as in the preceding embodiments.

In intake camshaft 8, there are formed advance fluid passage 81 and retard fluid passage 82 extending into intake camshaft 8 from the shaft end. Balls 81*a* and 82*a* are provided, respectively, at the axial ends of advance and retard fluid passages 81 and 82, so as to close the respective passage ends. These balls 81*a* and 82*a* are arranged to separate the advance and retard fluid passages from each other liquidtightly even when intake camshaft 8 and second vane rotor 75 rotate relative to each other. Moreover, the intake camshaft 8 of the fifth embodiment includes a bearing hole 8*b* formed at the center in the end of intake camshaft 8.

A second transmission sprocket 3*b* is fixed to second vane rotor 75 by a second cam bolt 80*a*. The forward end of second cam bolt 80*a* is received in the bearing hole 8*b* of intake camshaft 8, and supported rotatably by intake camshaft 8. First and second transmission sprockets 3*a* and 3*b* are connected by chain 6, so that the second vane rotor 75 fixed with second sprocket 3*b* rotates in phase with the first vane rotor 55 fixed with first sprocket 3*a*. Second VTC mechanism 7 is initially set at the most retarded position in the engine start state.

[Relation between crankshaft and camshafts] The valve timing control system according to the fifth embodiment determines the phases of exhaust camshaft 4 and intake camshaft 8 with respect to the rotation of crankshaft 1 in the following manner. When the crankshaft 1 rotates, the first housing 50 and exhaust camshaft 4 rotate as a unit, through chain 2. Therefore, in this example, the phase of exhaust camshaft 4 is invariable with respect to crankshaft 1.

In the engine start state of the most advanced position, the rotation of first housing 50 is transmitted directly to first vane rotor 55 by the first lock pin 56. When, on the other hand, first mechanism 5 is out of the most advanced position, the rotation is transmitted through the oil in first advance chambers 5*a* from first housing 50 to first vane rotor 55.

The rotation of first vane rotor 55 is transmitted synchronously to second vane rotor 75 by chain 6 between first and second sprockets 3*a* and 3*b*. In the engine start state, the rotation of second vane rotor 75 is transmitted directly to second housing 70 by the second lock pin 76, and further to the intake camshaft 8 fixed with second housing 70. When, on the other hand, second mechanism 7 is out of the initial position, the rotation is transmitted through the oil in second advance chambers 7*b* from second vane rotor 75 to second housing 70. The rotation is transmitted to intake camshaft 8 since the second housing 70 is fixed to intake camshaft 8.

In this way, the valve timing control system according to the fifth embodiment can alter the phase of intake camshaft 8 with respect to crankshaft 1, with the first and second mechanisms 5 and 7.

In the valve timing control system according to the fifth embodiment, the first VTC mechanism 5 is initially set at the most advanced position, and the second VTC mechanism 7 is set initially at the most retarded position. With the first and second timing control mechanisms 5 and 7, the valve timing control system of the fifth embodiment can perform both the advance control and retard control from the initial state of engine start. Alternatively, it is possible to employ, as the initial positions of first and second mechanism 5 and 7, the other positions as shown in the other embodiments. The first and second VTC mechanisms 5 and 7 can be controlled by controller 10 in the same manner as in the first embodiment.

Figure 34:
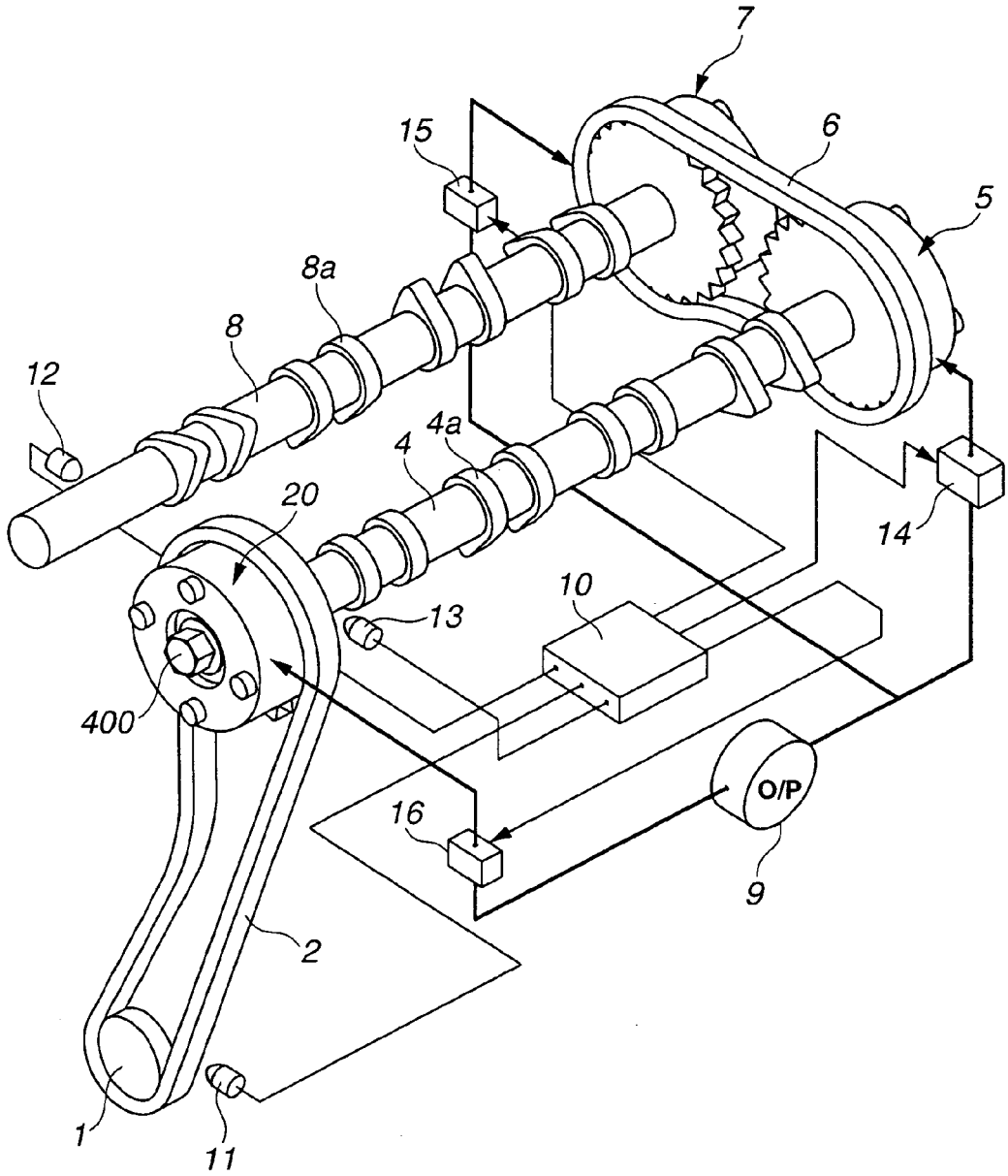
FIG. 34 is a perspective view schematically showing a valve timing control system according to a sixth embodiment.

A SIXTH EMBODIMENT is shown in FIGS. 34–37. As schematically shown in FIG. 34, an engine valve timing control apparatus or system according to the sixth embodiment includes a third valve timing control (VTC) mechanism 20 in addition to the first and second VTC mechanisms 5 and 7. As shown in FIG. 34, the first and second VTC mechanisms 5 and 7 are located on one side of the engine (which is referred to as a first side), and the third VTC mechanism 20 is located on the opposite side (a second side of the engine). Third mechanism 20 confronts the first and second mechanism 5 and 7 across the engine in the axial direction of crankshaft 1. This arrangement on both sides is advantageous for the flexibility of layout and the compactness around the camshafts.

Rotation of crankshaft 1 is transmitted by chain 2 to a drive sprocket 203*a* serving as a drive transmission member. In this example, the drive sprocket 203*a* is designed to rotate at a one-half crankshaft speed.

The first VTC mechanism 5 is provided at one end (hereinafter referred to as a first end) of exhaust camshaft 4, and the third VTC mechanism 20 is provided at the other end (referred to as a second end) of exhaust camshaft 4. The above-mentioned drive sprocket 203*a* is provided in third mechanism 20. Rotation transmitted to the drive sprocket 203*a* from crankshaft 1 is further transmitted, through third VTC mechanism 3, to exhaust camshaft 4. Then, rotation is transmitted, by chain 6 between first and second sprockets 53*a* and 73*a*, serving as a rotation transmitting member, in phase to the second sprocket 73*a* of second VTC mechanism 7.

The second VTC mechanism 7 is provided at one end (first end) of intake camshaft 8 at the side of first mechanism 5. Rotation transmitted to the second sprocket 73*a* is further transmitted, through second VTC mechanism 7, to intake camshaft 8 provided with intake cams 8*a* for operating intake valves of the engine. Oil pump 9 driven by the engine serves as a source of fluid pressure for all the first, second and third VTC mechanisms 5, 7 and 20.

The rotational position of crankshaft 1 is sensed by crank angle sensor 11 provided near crankshaft 1. There are further provided exhaust cam angle sensor 13 near one end of exhaust camshaft 4, for sensing the rotational position of exhaust camshaft 4; and intake cam angle sensor 12 near one of intake camshaft 8, for sensing the rotational position of intake camshaft 8. These sensors 11, 12 and 13 are connected with controller 10 which performing a feedback control by using information collected by these sensors as in the preceding embodiments.

Figure 35:
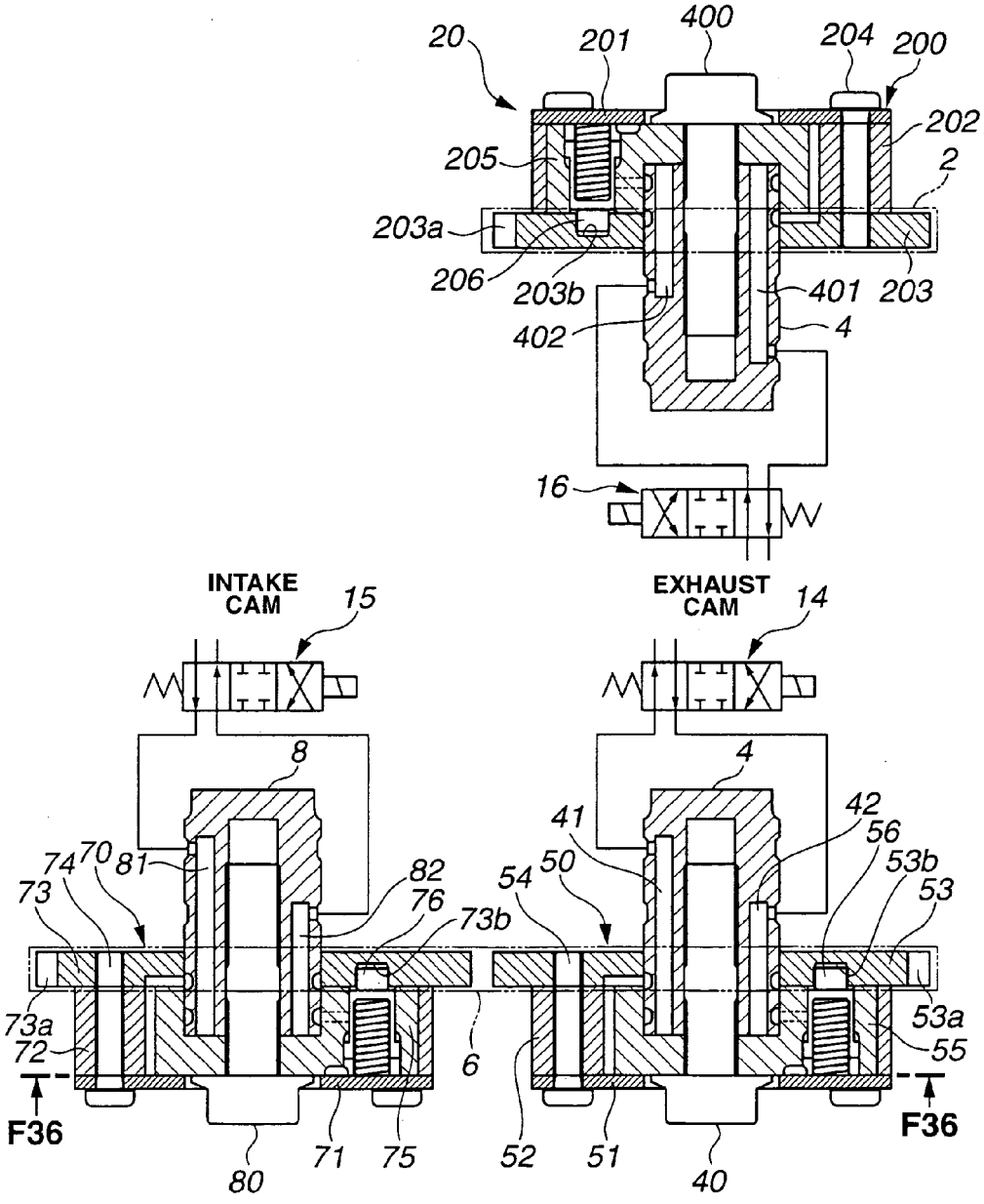
FIG. 35 is a sectional view showing valve timing control mechanisms of the valve timing control system of FIG. 34, taken across line F35—F35 shown in FIG. 36, in the engine start state.
Figure 36:
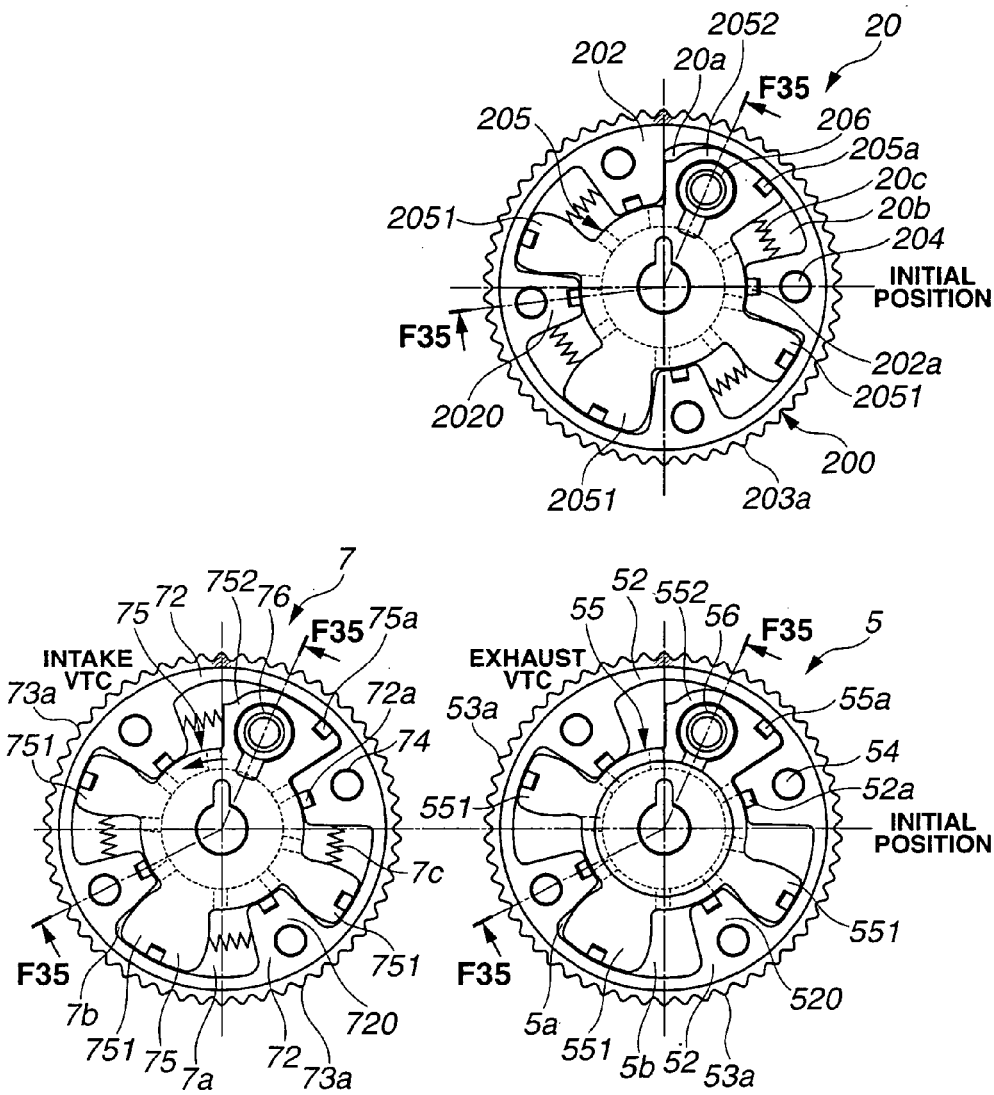
FIG. 36 is a sectional view showing the valve timing control mechanisms in the engine start initial state, taken across a line F36—F36 shown in FIG. 35.

FIGS. 35 and 36 show the first, second and third VTC mechanisms 5, 7 and 20 in the initial state at the time of engine starting operation. The first and second VTC mechanisms 5 and 7 are basically identical in construction to those shown in FIGS. 2 and 3 of the first embodiment, so that repetitive explanation is omitted.

[Construction of third valve timing control mechanism] Third VTC mechanism 20 includes a plurality of operating chambers formed in a third housing 200 and a plurality of vanes 2051, 2052 formed in a third vane rotor 205. In this example, third housing 200 has four of the operating chambers, and third vane rotor 205 has four of the vanes 2051, 2052 each of which is received in a unique one of the four operating chambers. Each operating chamber is divided into a third advance chamber 20*b* and a third retard chamber 20*a* by a corresponding one of the vanes 2051, 2052. Each of the advance chambers 20*b* is connected with an advance fluid passage 401; and each of the retard chambers 20*a* is connected with a retard fluid passage 402. Under the control of controller 10, a third hydraulic control device 16 controls the supply and drainage of the operating oil selectively to and from the advance and retard chambers 20*b* and 20*a* through advance and retard passages 401 and 402.

Third housing 200 includes a third front member (or plate) 201, a third housing member 202 and a third rear member (or plate) 203 which are joined together, into the integral third housing 200, by a plurality (four) of axially extending fastening devices 204 which are in the form of bolts 204 in this example. Third housing member 202 is sandwiched axially between third front and rear members 201 and 203. Third front member 201 faces away from exhaust camshaft 4. Third front member 201 is in the form of a relatively thin circular disk. Third housing member 202 encloses third vane rotor 205 and includes a plurality (four) of inward projections (shoes) 2020 projecting radially inwards and thereby defining a plurality (four) of the operating chambers. Third rear plate 203 is in the form of a plate, and third rear plate 203 is thicker than third front plate 201 as shown in FIG. 35. Third rear plate 203 is formed with a center hole receiving exhaust camshaft 4. Bolts 204 are inserted from the front plate's side, and third front plate 201 is clamped between the heads of bolts 204 and third housing member 202. The before-mentioned drive sprocket or third sprocket 203*a* is formed integrally in the outer circumference of third rear member 203.

Third vane rotor 205 is formed with a plurality (four) of the vanes 2051, 2051, 2051 and 2052 projecting radially outwards at approximately regular angular intervals around the center axis. One of the vanes is a wider vane 2052 which is wider in the circumferential direction than the remaining (three) vanes 2051, as shown in FIG. 36. Wider vane 2052 is formed with an axially extending hole receiving therein a third lock pin 206 serving as a third holding device. Third lock pin 206 is axially slidable in the axial hole of wider vane 2052, and is normally urged by a resilient member such as a spring toward the third rear plate 203. Third rear plate 203 is formed with a third lock hole 203*b* for receiving the third lock pin 206. In the state of FIG. 35, the third lock pin 206 is engaged in third lock hole 203*b*. When the oil pressure is applied through advance passage 201 or retard passage 202, the third lock pin 206 is released against the resilient force of a spring.

In the engine start operation, the third lock pin 206 is engaged in the third lock hole 203*b*, and hence the third housing 200 and third vane rotor 205 rotate as a unit. When third lock pin 206 is disengaged from third lock hole 203*b*, the third housing 200 and third vane rotor 205 can rotate relative to each other. Thus, the third lock pin 206 holds the third housing 200 and vane rotor 205 engaged as a unit even when a sufficient oil pressure is not available, and thereby prevents undesired flapping due to alternating torque produced by the action of valve springs and cams.

An outer seal member 205*a* of resin is provided in a groove in the outer end of each vane 2051, 2052 of vane rotor 205, and urged radially outwards by a plate spring, to an inside cylindrical surface of third housing member 202, to seal a sliding contact region between third vane rotor 205 and third housing 200. On the other hand, an inner seal member 202*a* of resin is provided in a groove formed in the inner end of each inward projection (or shoe) 2020 of third housing 200, and urged radially inwards by a plate spring, to an outside cylindrical surface of third vane rotor 205, to seal a sliding contact region between third vane rotor 205 and third housing 200. Therefore, each vane 2051, 2052 defines the third advance and retard chambers 20*b* and 20*a* liquidtightly on both sides.

In the engine start initial state at the time of an engine starting operation, the third vane rotor 205 is locked at a most advanced position by the third lock pin 206 engaging in the third lock hole 203*b*, so that the third vane rotor 205 and third housing 200 rotate as a unit. However, when the operating oil is supplied to the third advance chambers 20*b* or the third retard chambers 20*a* from oil pump 9, the oil pressure is applied to the third lock pin 206 against the spring, and the third lock pin 206 is disengaged from the third lock hole 203*b*.

When the operating oil is supplied to the third advance chambers 20*b*, then the third housing 200 rotates in the advance direction with respect to the third vane rotor 55, and thereby provides an operating angle. When the operating oil is supplied to the third retard chambers 20*a*, then the third housing 200 rotates in the retard direction with respect to the third vane rotor 205, and thereby provides an operating angle.

A resilient member 20*c* in the form of a coil spring is disposed in each of the third advance chambers 20*b*, as shown in FIG. 36. Each resilient member 20*c* is disposed between the third housing member 202 (one of the inward projections 2020) and the third vane rotor 205. By the resilient members 20*c*, the third vane rotor 205 is urged in the advance direction with respect to the third housing 200. The resilient forces of resilient members 20*c* are so set that the advance torque in the advance direction is greater than the retard torque in the alternating torque produced by the valve springs and cams. Therefore, when the oil supply from oil pump 9 is stopped and the oil pressure becomes lower in the third advance and retard chambers 20*b* and 20*a*, the third vane rotor 205 returns to the most advanced position, that is the state at the time of engine start operation, by the alternating torque. Each resilient member 7*c* may be a torsion spring, a plate spring or a spiral spring, instead of a coil spring.

[Relation between crankshaft and camshafts] The valve timing control system according to the sixth embodiment determines the phases of exhaust camshaft 4 and intake camshaft 8 with respect to the rotation of crankshaft 1 in the following manner. When crankshaft 1 rotates, the third housing 200 is rotated through chain 2. In the engine start state of the most advanced position, the rotation of third housing 200 is transmitted directly to third vane rotor 205 by the third lock pin 206 (or by the abutment between third housing 200 and third vane rotor 205). When, on the other hand, third mechanism 20 is out of the most advanced position, the rotation is transmitted through the oil in third retard chambers 20*a* from third housing 200 to third vane rotor 205.

The third vane rotor 205 is fixed to exhaust camshaft 4 by a third cam bolt 400, so that they rotate as a unit. Therefore, rotation of third vane rotor 205 is transmitted by exhaust camshaft 4, to first vane rotor 55 of first VTC mechanism 5. In the first VTC mechanism 5, when in the engine start initial state of the most retarded position, the rotation of first vane rotor 55 is transmitted directly to first housing 50 by first lock pin 56 (or by the abutment between first vane rotor 55 and first housing 50). When first mechanism 5 is out of the most retarded position, the rotation of first vane rotor 55 is transmitted to first housing 50 though the oil in first advance chambers 5*a*.

The rotation of first housing 50 is transmitted synchronously to second housing 70 by chain 6 between first and second sprockets 53*a* and 73*a*. In the engine start state in which the second VTC mechanism 7 is in the most advanced position, the rotation of second housing 70 is transmitted directly to second vane rotor 75 by the second lock pin 76, and further to the intake camshaft 8 fixed with second vane rotor 75. When, on the other hand, the second mechanism 7 is out of the most advanced position, the rotation is transmitted through the oil in second advance chambers 7*a* from second housing 70 to second vane rotor 75.

(Valve timing control only by the third valve timing control mechanism) The valve timing control system is operated in the following manner when the valve timing control is performed only by the third VTC mechanism 20. Advance Control: In the case of the advance control of third VTC mechanism 20, the fluid pressure is supplied to third advance chambers 20*b*, and the phase of third vane rotor 205 is shifted in the advance direction so as to produce the operation angle in the advance angle to alter the phase of exhaust camshaft 4 with respect to crank shaft 1. In this case, when the first and second VTC mechanisms 5 and 7 are in the respective initial states, the phase of first housing 50 is shifted simultaneously, and the phase shift is transmitted by chain 6 to second housing 70, so that the phase of second vane rotor 75 is shifted simultaneously. Thus, when only the third VTC mechanism 20 is actuated to perform the advance control and the first and second VTC mechanisms 5 and 7 are held in the initial states, the phases of exhaust camshaft 4 and intake camshaft 8 are both shifted simultaneously in the advance direction with respect to crankshaft 1. Retard Control: In the case of the retard control of third VTC mechanism 20, the fluid pressure is supplied to third retard chambers 20*a*, and the phase of third vane rotor 205 is shifted in the retard direction so as to produce the VTC operation angle in the retard direction. This VTC operation angle shifts the phase of exhaust camshaft 4. In this case, when the first and second VTC mechanisms 5 and 7 are in the respective initial states, the phase of first housing 50 is shifted simultaneously, and the phase shift is transmitted by chain 6 to second housing 70, so that the phase of second vane rotor 75 is shifted simultaneously. Thus, when only the third VTC mechanism 20 is actuated to perform the retard control and the first and second VTC mechanisms 5 and 7 are held in the initial states, the phases of exhaust camshaft 4 and intake camshaft 8 are both shifted simultaneously in the retard direction with respect to crankshaft 1.

In this way, third VTC mechanism 20 is arranged to shift the phases of exhaust camshaft 4 and intake camshaft 8 simultaneously with respect to crankshaft 1. On the other hand, the first and second VTC mechanisms 5 and 7 are both arranged to shift the phase of intake camshaft 8 with respect to crankshaft 1, as in the first embodiment. In the combination of first and second VTC mechanisms 5 and 7, the phase of intake camshaft 8 with respect to crankshaft is shifted by the conversion angle which is equal to the sum of the operation angle of first VTC mechanism 5 and the operation angle of second VTC mechanism 7.

The valve timing control system of the sixth embodiment can perform the retard control only for exhaust camshaft, for example, by controlling third VTC mechanism 20 in the retard control mode, and controlling the first and second VTC mechanism 5 and 7 in the advance control mode in phase. Thus, the system of the sixth embodiment can control the phases of exhaust and intake camshafts 4 and 8 individually.

[Relation between engine driving condition and valve timing control mechanisms] The first, second and third VTC mechanisms 5, 7 and 20 are operated in dependence on the engine driving condition in the following manner.

(When the system is restored to the initial state for engine start before a complete stop of the engine) When the engine is stopped, the valve timing control system normally restores the first, second and third VTC mechanisms 5, 7 and 20, as a control end operation, to the engine start state in which the first, second and third lock pins 56, 76 and 206 are engaged, respectively, in the first, second and third lock holes 53*b*, 73*b* and 203*b*. Therefore, the system can control the first, second and third mechanisms 5, 7 and 20 from the initial engine start state irrespective of whether the oil pressure is available or not, and hence prevent flapping between the vane housing and housing by the alternating torque at the time of engine restart operation.

However, if the engine stalls before the control end operation to restore the first, second and third mechanisms 5, 7 and 20 to the engine start state, the crankshaft stops after several revolutions due to the inertial force, and alternating torque is applied to exhaust camshaft 4. In this case, the integral of the alternating torque with respect to the number of revolutions becomes negative because of the resilient forces of the resilient members 20*c*. Therefore, third vane rotor 205 and first vane rotor 55 rotating as a unit with exhaust camshaft 4 receive the torque in the advance direction with respect to the rotational direction. Accordingly, third vane rotor 205 is urged toward the most advanced position, and returned to the initial position, reliably.

On the other hand, an alternating torque acts on intake camshaft 8. Since the integral of the alternating torque with respect to the number of revolutions becomes positive, the positive torque is applied in the retarding direction on the second vane rotor 75 rotating as a unit with the intake camshaft 8. In this case, resilient members 7*c* urge the second vane rotor 75 in the advance direction, and the second vane rotor 75 is returned to the most advanced position in the initial engine start state.

When first housing 50 is positioned on the advance side with respect to first vane rotor 55 in first VTC mechanism 5, a positive torque acting on the second vane rotor 75 (intake camshaft 8) is transmitted through the second lock pin 76 to the second housing 70 in the second VTC mechanism 7 in the engine start state of the most advanced position. Therefore, the first housing 50 is returned in the retard side by the second housing 70, and the first VTC mechanism 5 is restored to the most retarded position. Even if the second mechanism 7 is not in the engine start state, the positive torque is transmitted by the resilient members 7*c* through second housing 70 to first housing 50, so that the first mechanism is returned to the most retarded position of the engine start state.

If the third valve timing mechanism 20 is not returned to the initial position while the second valve timing mechanism 7 is returned to the initial position and the first valve timing mechanism 5 is returned to the initial state, the third vane rotor 205 receives the alternating torque of intake camshaft 8 and the alternating torque of exhaust camshaft 4. Therefore, the third VTC mechanism 20 can readily return to the engine start initial state.

(When the system is not restored to the initial state for engine start before a complete stop of the engine) When the engine stalls before the control end operation to restore the first, second and third mechanisms 5, 7 and 20 to the engine start initial state, the system is not in the engine start state at the time of a next engine start operation. In this case, the third housing 200 is rotated by crankshaft 1 in the engine restart operation. Even if the third housing 200 and third vane rotor 205 are disengaged, the third housing 200 is urged by resilient member 20*c* in the advance direction and returned toward the initial position. Therefore the third lock pin 206 engages in the third lock hole 203*b*, and thereby prevents flapping between the third housing 200 and third vane rotor 205.

When first vane rotor 55 is rotated by third vane rotor 205, the first vane rotor 55 is moved toward the initial position even if first vane rotor 55 and first housing 50 are disengaged. Therefore, the first lock pin 56 engages in the first lock hole 53*b*, and thereby prevents flapping between first vane rotor 55 and first housing 50.

The rotation of first housing 50 is transmitted to second housing 70, and then the rotation of second housing 70 is transmitted through the resilient members 7*c* to the second vane rotor 75. Although the second vane rotor 75 receives an alternating torque as mentioned before, the second vane rotor 75 is urged in the advance direction by the resilient members 7*c*. Therefore, the second lock pin 76 reliably engages in the second lock hole 73*b*, and thereby prevents flapping between the second vane rotor 75 and second housing 70.

In the illustrated example of the third embodiment, the third VTC mechanism 20 is initially set at the most advanced position for the engine start state, and the first and second VTC mechanisms 5 and 7 are initially set as in the first embodiment. However, the sixth embodiment of the invention is not limited to this arrangement. For example, it is possible to employ the initial setting of the second embodiment.

The third VTC mechanism 20 may be set initially at the most retarded position. In this case, the same effects can be obtained by omitting resilient members 20*c* disposed in the third advance chambers 20*b* for urging third vane rotor 205 in the advance direction.

Figure 37:
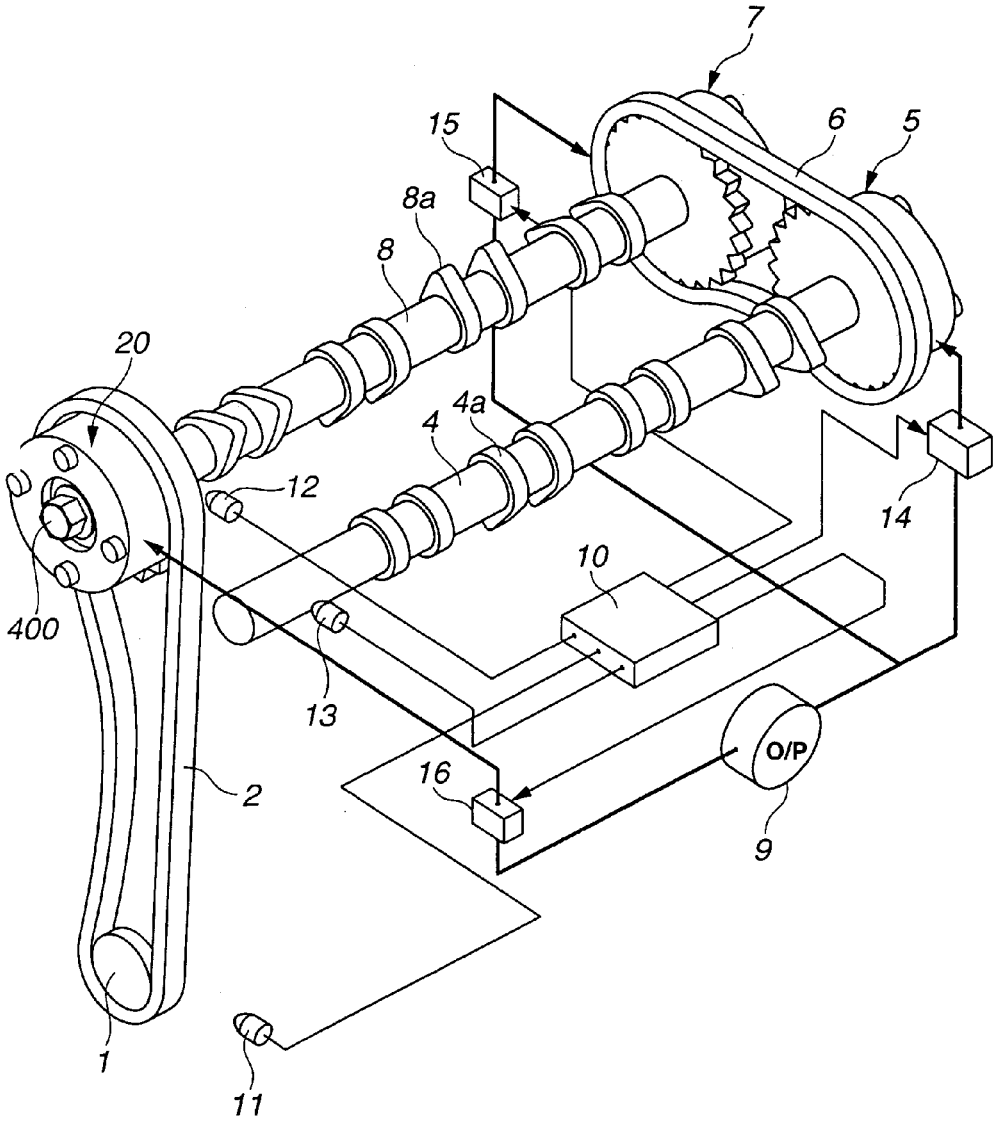
FIG. 37 is a perspective view schematically showing a valve timing control system in a variation of the sixth embodiment.

FIG. 37 shows a variation of the sixth embodiment. In the system shown in FIG. 37, the third VTC mechanism 20 is connected with one end of intake camshaft 8. The system shown in FIG. 37 are constructed and operated basically in the same manner as shown in FIGS. 34, 35 and 36.

Figure 38:
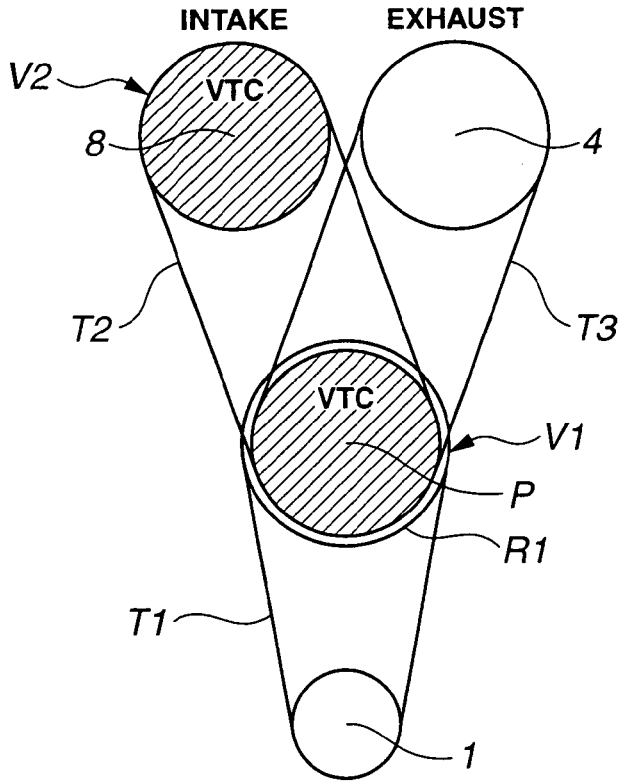
FIG. 38 is a schematic side view showing a valve timing control system according to a seventh embodiment of the present invention.
Figure 39:
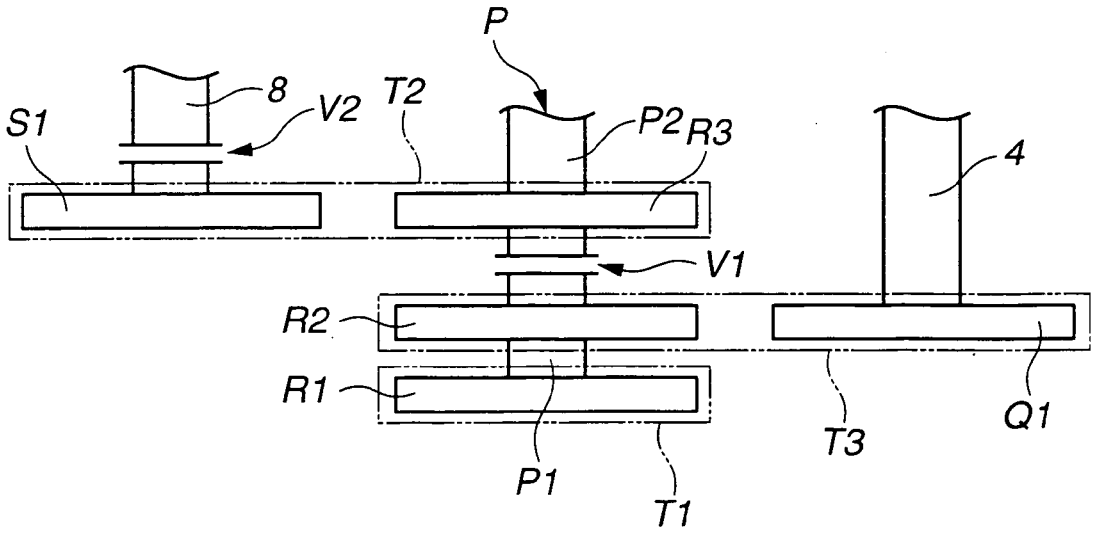
FIG. 39 is a schematic top view showing the valve timing control system according to the seventh embodiment.

FIGS. 38 and 39 show a valve timing control apparatus according to a SEVENTH EMBODIMENT of the present invention. In the preceding embodiments, the first and second VTC mechanisms are provided, respectively, at the ends of the exhaust and intake camshafts. Therefore, the preceding embodiments employ a three-shaft arrangement including crankshaft 1, exhaust camshaft 4 and intake camshaft 8. By contrast, the seventh embodiment employs a four-shaft arrangement including an intermediate shaft or drive transmission shaft (P) between the crankshaft 1 and the camshafts 4 and 8.

FIGS. 38 and 39 are side view and plan view showing the four-shaft arrangement according to the seventh embodiment schematically. In FIG. 38, VTC stands for a VTC mechanism or device which can alter the phase of an output rotation with respect to an input rotation. As VTC, it is possible to employ various valve timing control devices.

As shown in FIG. 38, an intermediate shaft (or drive transmission shaft) P is provided between the crankshaft 1 and the exhaust and intake camshafts 4 and 8. The intermediate shaft P is composed of an input side shaft P1 and an output side shaft P2 which are aligned end to end as shown in FIG. 39. A first VTC mechanism V1 is provided between the input side shaft P1 (which can serve as an input member of V1) and the output side shaft P2 (which can serve as an output member of V1). A second VTC mechanism V2 is provided at one end of intake camshaft 8.

The input side shaft P1 is provided with an input sprocket (wheel member) R1 (which can also serve as the input member of V1) and an output sprocket (wheel member) R2, as best shown in FIG. 39. The output side shaft P2 is provided with an output sprocket (wheel member) R3 (which can also serve as the output member of V1). Exhaust camshaft 4 is provided with an input sprocket (wheel member) Q1, and intake camshaft 8 is provided with an input sprocket (wheel member) S1.

A chain (flexible connecting member) T1 is arranged to transmit rotation from crankshaft 1 to input sprocket R1 of input side shaft P1 of intermediate shaft P. The input sprocket R1 is connected with output sprocket R2 by input side shaft P1, so that output sprocket R2 rotates as a unit with input sprocket R1. A chain (flexible connecting member) T3 is arranged to transmit the rotation of output sprocket R2 to input sprocket Q1 of exhaust camshaft 4, so that the rotation of crankshaft 1 is transmit in phase to exhaust camshaft 4.

The rotation of input side shaft P1 is transmitted to the output side shaft P2 through the first VTC mechanism V1. The output side shaft P2 rotates as a unit with output sprocket R3, and the output sprocket R3 is connected with input sprocket S1 by a chain (flexible connecting member) T2. The rotation of input sprocket S1 is transmitted to intake camshaft 8 through the second VTC mechanism V2.

Thus, this valve timing control system can alter the rotational phase of intake camshaft 8 with the respect to crankshaft 1 with the first and second VTC mechanism V1 and V2 which are arranged in series. The same effects can be obtained as in the preceding embodiments by setting the initial positions of the first and second VTC mechanisms in the engine start state.

Figure 40:
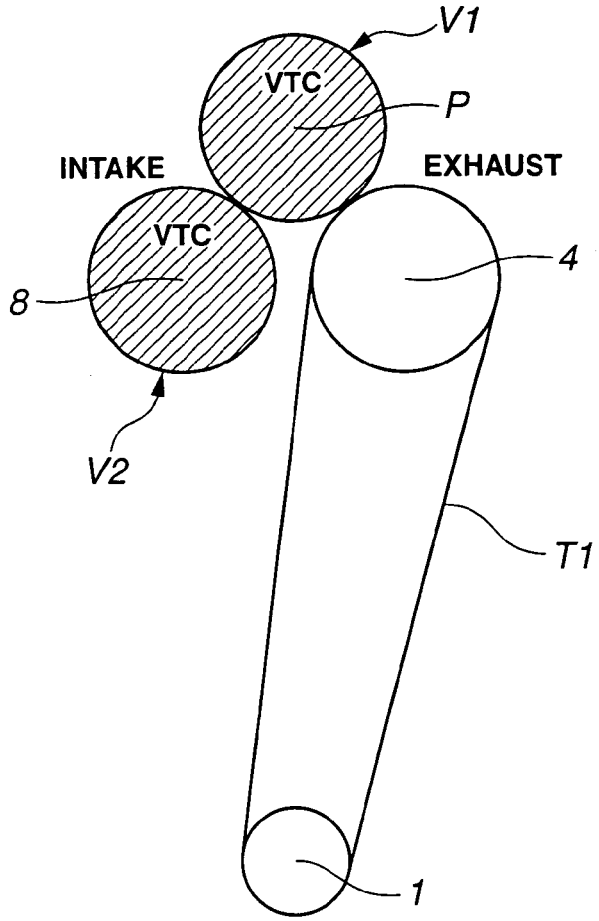
FIG. 40 is a schematic side view showing a valve timing control system according to an eighth embodiment of the present invention.
Figure 41:
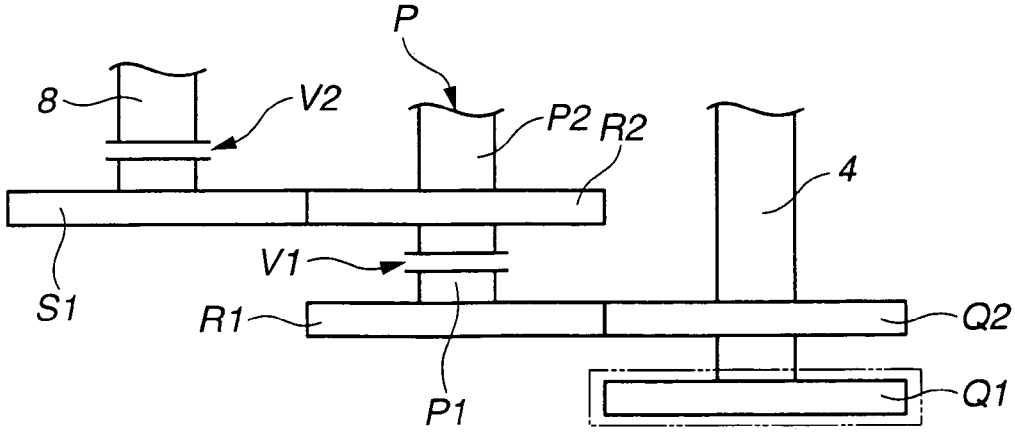
FIG. 41 is a schematic top view showing the valve timing control system according to the eighth embodiment.

FIGS. 40 and 41 show a valve timing control apparatus according to an EIGHTH EMBODIMENT of the present invention. In the seventh embodiment, rotation of crankshaft 1 is inputted to first VTC mechanism V1. In the eighth embodiment, by contrast, the crankshaft rotation is first inputted to exhaust camshaft 4. Rotation is then transmitted from exhaust camshaft 4 to first VTC mechanism V1 and second VTC mechanism V2. Moreover, the eighth embodiment employs a gear drive using a gear such as scissors gear in place of a chain drive.

As shown schematically in the side view of FIG. 40, an intermediate shaft or drive transmission shaft P is provided between exhaust camshaft 4 and intake camshaft 8. The intermediate shaft P is composed of an input side shaft P1 and an output side shaft P2. A first VTC mechanism V1 is provided between the input side shaft P1 and the output side shaft P2. A second VTC mechanism V2 is provided at one end of intake camshaft 8.

An input sprocket Q1 and an output gear Q2 are provided in an end portion of the exhaust camshaft 4. The input side shaft P1 is provided with an input gear R1, and the output side shaft P2 is provided with an output gear R2. Intake camshaft 8 is provided with an input gear S1.

Rotation is transmitted from crankshaft 1 to input sprocket Q1 of exhaust camshaft 4 by a chain T1, so that exhaust cam shaft 4 rotates in phase with crankshaft 1. Input sprocket Q1 is connected with output gear Q2 by exhaust camshaft 4 so that input sprocket Q1 and output gear Q2 rotates as a unit. Output gear Q2 is engaged with input gear R1 of input side shaft P1. Input gear R1 and input side shaft P1 rotate as a unit.

Rotation of input side shaft P1 is transmitted to output side shaft P2 through first VTC mechanism V1. Output side shaft P2 rotates as a unit with output gear R2, which is engaged with input gear S1. Rotation transmitted from output gear R2 to input gear S1 is further transmitted from input gear S1 to intake camshaft 8 through second VTC mechanism V2.

Thus, this valve timing control system shown in FIGS. 40 and 41 can alter the rotational phase of intake camshaft 8 with the respect to crankshaft 1 with the first and second VTC mechanism V1 and V2 which are arranged in series. The same effects can be obtained as in the preceding embodiments by setting the initial positions of the first and second VTC mechanisms in the engine start state.

Figure 42:
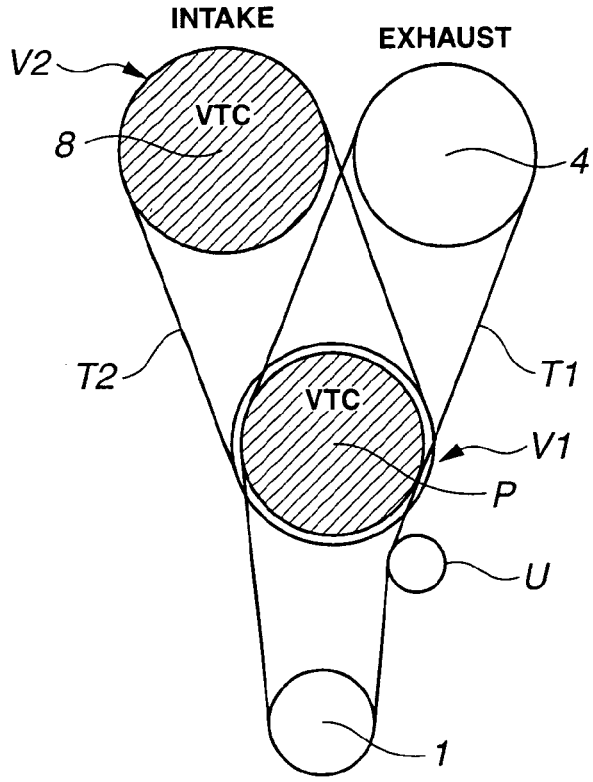
FIG. 42 is a schematic side view showing a valve timing control system according to a ninth embodiment of the present invention.
Figure 43:
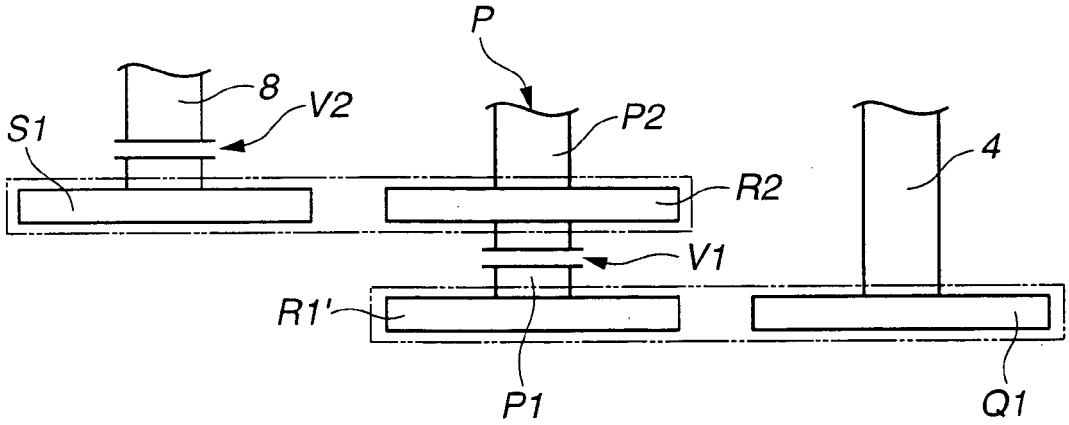
FIG. 43 is a schematic top view showing the valve timing control system according to the ninth embodiment.

FIGS. 42 and 43 show a valve timing control apparatus according to a NINTH EMBODIMENT of the present invention. In the seventh embodiment, rotation of crankshaft 1 is transmitted to exhaust camshaft 4 and intake camshaft 8 by three chains T1, T2 and T3 or by three belts when the belt drive is employed instead of chain drive. In the ninth embodiment, by contrast, the crankshaft rotation is transmitted to a first VTC mechanism V1 and exhaust camshaft 4 by a single belt T1. Moreover, in the illustrated example, there is provided, for belt T1, a tensioner U for securing the transmission of rotation to first VTC mechanism V1. However, it is possible to omit the tensioner.

As shown in FIG. 43, the arrangement of the ninth embodiment is similar to the arrangement of the seventh embodiment shown in FIG. 39. Instead of input sprocket R1 and output sprocket R2 shown in FIG. 39 of the seventh embodiment, there is provided, on the input side shaft P1 of intermediate shaft P, an input/output wheel member R1' such as a pulley or a sprocket. Therefore, it is possible to reduce the number of required component parts. Belt T1 is arranged to transmit rotation of crankshaft 1 to input/output wheel member R1' of intermediate shaft P and simultaneously to input wheel member Q1 provided at one end of exhaust camshaft 4. In other points, the arrangement according to the ninth embodiment is similar to the arrangement of the seventh embodiment.

Thus, this valve timing control system shown in FIGS. 42 and 43 can alter the rotational phase of intake camshaft 8 with the respect to crankshaft 1 with the first and second VTC mechanism V1 and V2 which are arranged in series. The same effects can be obtained as in the preceding embodiments by setting the initial positions of the first and second VTC mechanisms in the engine start state.

Figure 44:
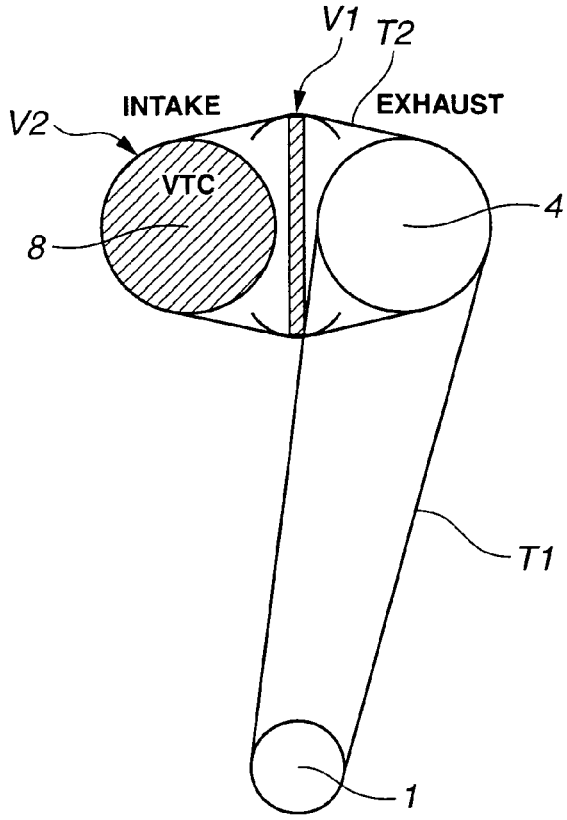
FIG. 44 is a schematic side view showing a valve timing control system according to a tenth embodiment of the present invention.

FIG. 44 is a schematic side view showing a valve timing control apparatus or system according to a TENTH EMBODIMENT. In the arrangement of FIG. 44, rotation of crankshaft 1 is transmitted to exhaust camshaft 4 by a flexible connecting member T1 such as a belt, and rotation is further transmitted from exhaust camshaft 4 by a belt T2 of a first VTC mechanism V1 of a variable tensioner type, to a second VTC mechanism V2 provided at one end of intake camshaft 8.

Figure 45A:
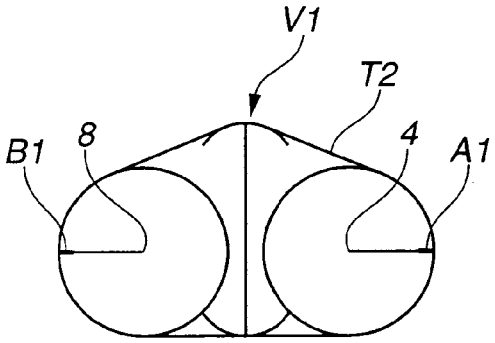
FIGS. 45A and 45B are schematic top views for illustrating operations of the valve timing control system according to the tenth embodiment.
Figure 45B:
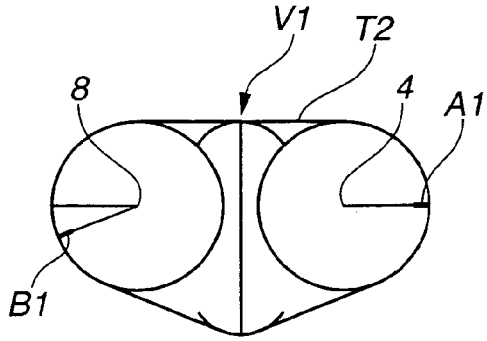

FIGS. 45A and 45B illustrate operations of the variable tension type VTC mechanism V1. In the state shown in FIG. 45A, first VTC mechanism V1 applies a belt tension upward as viewed in the figure on an upper part of the belt T2. In FIG. 45A, A1 indicates a reference position of exhaust camshaft 4, and B1 indicates a reference position of intake camshaft 8. In the state shown in FIG. 45B, first VTC mechanism V1 applies a belt tension downward as viewed in the figure on a lower part of the belt T2. In the state of FIG. 45B, since the belt length is not changed, the reference position B1 is shift to a position at which the belt length from the reference position A1 is unchanged, as shown in FIG. 45B. In this way, the variable tension type VTC mechanism V1 can alter the rotational phase of intake camshaft 8 with respect to exhaust camshaft 4. As the second VTC mechanism V2, it is possible to employ the VTC mechanism as in the preceding embodiments.

Thus, this valve timing control system shown in FIGS. 44 and 45 (45A and 45B) can alter the rotational phase of intake camshaft 8 with the respect to crankshaft 1 with the first and second VTC mechanism V1 and V2 which are arranged in series. The same effects can be obtained as in the preceding embodiments by setting the initial positions of the first and second VTC mechanisms in the engine start state.

Figure 46:
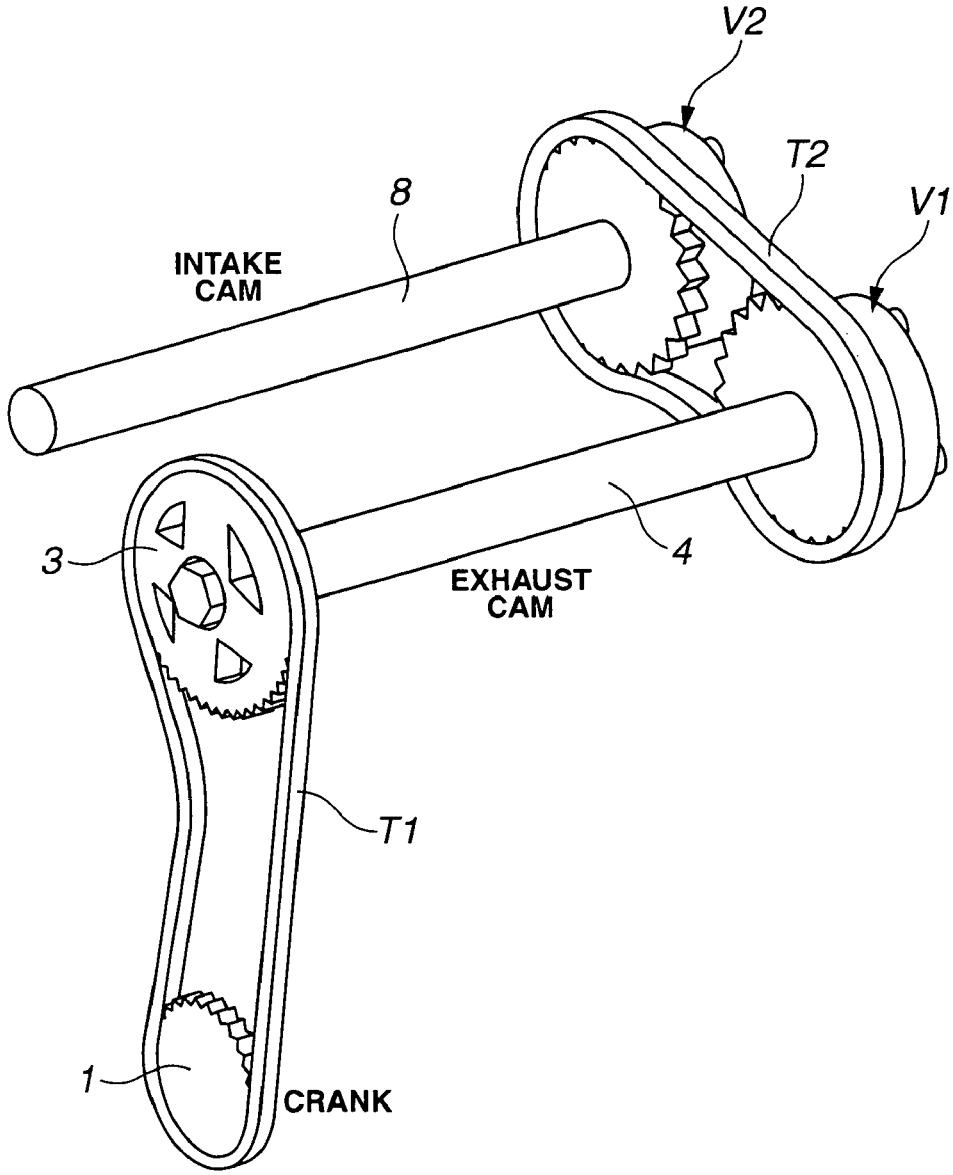
FIG. 46 is a schematic perspective view showing a valve timing control system according to an eleventh embodiment of the present invention.

FIG. 46 shows, in perspective, a valve timing control apparatus or system according to an ELEVENTH EMBODIMENT. The construction shown in FIG. 46 is basically the same as that of the first embodiment shown in FIG. 1. The construction shown in FIG. 46 is different from the first embodiment only in the following points. As shown in FIG. 46, a drive sprocket 3 is provided at a first end of exhaust camshaft 4, and first VTC mechanism V1 is provided at a second end of exhaust camshaft 4. Intake camshaft 8 extends in parallel to exhaust camshaft 4, from a first end near the first end of exhaust camshaft 8, to a second end near the second end of exhaust camshaft 4. Second VTC mechanism V2 is provided at the second end of intake camshaft 8, as shown in FIG. 46. Thus, the drive sprocket 3 is on one side of the exhaust and intake camshafts 4 and 8 and the first and second VTC mechanisms V1 and V2 are on the opposite side of the camshafts 4 and 8. The drive sprocket 3 is separated axially from first VTC mechanism V1. Therefore, the construction of first VTC mechanism V1 can be simplified into a compact unit.

The valve timing control system shown in FIG. 46 can alter the rotational phase of intake camshaft 8 with the respect to crankshaft 1 with the first and second VTC mechanism V1 and V2 which are arranged in series. The same effects can be obtained as in the preceding embodiments by setting the initial positions of the first and second VTC mechanisms in the engine start state.

The present invention is not limited to the illustrated embodiments. Various modifications and variations are possible within the scope of the invention. For example, in place of a chain drive including a chain and timing sprockets, it is possible to employ a belt drive including a timing belt of flexible material such as rubber and timing belt pulleys. The belt drive is free from engagement noises, and hence advantageous in noise reduction. The connecting member 6 may be a belt of flexible material such as rubber, instead of chain. Alternatively, in place of the chain or belt drive, it is optional to employ a gear drive for transmitting rotation. The gear drive is advantageous in compactness and weight reduction. In the case of the gear drive, it is possible to employ scissors gears which are advantageous for reducing backlash and reducing undesired noises.

As the VTC mechanisms, it is possible to employ the hydraulically controlled vane type variable VTC mechanisms, and various other mechanisms. For example, it is possible to employ a valve timing control mechanism using a helical gear which is engaged with both a follower member and a camshaft's side member and which is arranged to move axially by the aid of oil pressure, to shift the relative rotational phase between the follower member and the camshaft's side member. Moreover, it is possible to employ electric or magnetic valve timing control devices. For example, it is possible to employ a valve timing control device which is actuated by acceleration or deceleration with an acceleration/deceleration for acceleration or deceleration with an electric motor or an electromagnetic brake.

As a holding device for holding a valve timing control mechanism in an initial position such as the most advanced position or the most retarded position, it is possible to a clutch mechanism or a lever mechanism instead of a hydraulically operated spring-loaded lock pin. Moreover, the holding device need not lock a valve timing control mechanism completely as long as the holding device can hold the valve timing control mechanism in a state preventing undesired fluttering. For example, the holding device may be a spring or other resilient means. Alternatively, the valve timing control mechanism may be arranged to return to the initial position by the aid of alternating torque having unequal positive and negative torques.

The resilient members (7*c*, 5*c*) between a housing and a vane rotor of a valve timing control mechanism may be torsion springs, or spiral springs. A coil spring may be disposed in each of the advance chambers and the retard chambers, and arrange to apply a resilient force directly on the vane.

The following technical concepts can be derived from these embodiments according to the present invention.

A valve timing control apparatus for an internal combustion engine according to one aspect of the invention, comprises: a first operating section including a first input member adapted to receive rotation from the engine, and a first output member, the first operating section being arranged to alter a rotational phase of the first output member with respect to the first input member; and a second operating section including a second input member connected with the first output member by a connecting member, and a second output member adapted to operate a cam of the engine; the second operating section being arranged to alter a rotational phase of the second output member with respect to the second input member.

The first operating section may include a first hydraulically operated VTC mechanism and a first fluid regulating device for regulating a fluid pressure supplied to the first VTC mechanism; or alternatively the first operating section may include only the first hydraulically operated VTC mechanism. The second operating section may include a second hydraulically operated VTC mechanism and a second fluid regulating device for regulating a fluid pressure supplied to the second VTC mechanism; or alternatively the second operating section may include only the second hydraulically operated VTC mechanism. One of the first input and output members may be a housing such as item 50 or 70 and the other of the first input and output members may be a vane rotor such as 55 or 75 rotatable in the housing only within a limited angular range. Similarly, one of the second input and output members may be a housing such as item 70 or 50 and the other of the second input and output members may be a vane rotor such as 75 or 55 rotatable in the housing only within a limited angular range. In this case, the first fluid regulating device is arranged to control the relative angular position between the first input and output members. Similarly, the second first fluid regulating device is arranged to control the relative angular position between the second input and output members. The second output member may include a camshaft for operating the cam of the engine.

In the first and second embodiments (FIGS. 1–10 and FIGS. 11–17), the first vane rotor 55 can be regarded as the first input member; the first housing 50 as the first output member; the second housing 70 as the second input member; and the second vane rotor 75 as the second output member. In the third and fourth embodiments (FIGS. 18–24 and FIGS. 25–31), the second vane rotor 75 can be regarded as the first input member; the second housing 70 as the first output member; the first housing 50 as the second input member; and the first vane rotor 55 as the second output member. In the fifth embodiment (FIGS. 32 and 33), the first housing 50 can be regarded as the first input member; the first vane rotor 55 as the first output member; the second vane rotor 75 as the second input member; and the second housing 70 as the second output member. Another embodiment similar to the fifth embodiment is possible in which the second housing 70 fixed to the intake camshaft 8 is arranged to serve as the first input member; the second vane rotor 75 as the first output member; the first vane rotor 55 as the second input member; and the first housing 50 fixed to the exhaust camshaft 4 as the second output member.

In the illustrated embodiments according to the invention, none of the VTC mechanisms (such as 5, 7 and 20) is coaxial with the crankshaft 1. The first and second VTC mechanisms (such as 5 and 7) are both arranged to alter a rotational phase of a first (intake or exhaust) camshaft of the engine with respect to a crankshaft, without altering the rotational phase of a second (exhaust or intake) camshaft of the engine.

According to one aspect of the invention, at least one of the first and second VTC mechanisms may include a biasing device (such as 7*c*) disposed between the housing and the vane rotor, and arranged to urge the vane rotor and housing in the advance direction, and the VTC mechanism provided with the biasing means is initially set at the most retarded position.

The first and second VTC mechanisms may include the first and second holding devices for holding the first and second VTC mechanism at the respective initial positions which are both the most retarded position. In this case, the mechanisms can be restored to the respective initial states spontaneously by the alternating torque without the aid of a resilient member.

A valve timing control apparatus according to one aspect of the invention comprises: intake and exhaust camshafts; a first housing which is provided at a first end of the intake camshaft and which is arranged to be rotatable with respect to the intake camshaft only within a limited range; a second housing which is provided at a first end of the exhaust camshaft and which is arranged to be rotatable with respect to the exhaust camshaft only within a limited range; a third housing which is provided at a second end of the intake or exhaust camshaft and which is arranged to be rotatable only within a limited range; a drive transmission member to transmit a crankshaft rotation to the third housing; a rotation transmission member to rotate the first and second housings in phase; a first vane rotor which is fixed with the intake camshaft and which is received in the first housing to define an operating chamber in the first housing; a second vane rotor which is fixed with the exhaust camshaft and which is received in the second housing to define an operating chamber in the second housing; a third vane rotor which is fixed with the camshaft provided with the third housing and which is received in the third housing to define an operating chamber in the third housing; a first fluid regulating device to regulate the supply and drainage of an operating fluid to and from the operating chamber between the first housing and the first vane rotor; a second fluid regulating device to regulate the supply and drainage of the operating fluid to and from the operating chamber between the second housing and the second vane rotor; and a third fluid regulating device to regulate the supply and drainage of the operating fluid to and from the operating chamber between the third housing and the third vane rotor.

A valve timing control apparatus according to one aspect of the invention comprises: intake and exhaust camshafts; a first vane rotor which is provided at a first end of the intake camshaft and which is arranged to be rotatable with respect to the intake camshaft only within a limited range; a second vane rotor which is provided at a first end of the exhaust camshaft and which is arranged to be rotatable with respect to the exhaust camshaft only within a limited range; a third vane rotor which is provided at a second end of the intake or exhaust camshaft and which is arranged to be rotatable only within a limited range; a drive transmission member to transmit a crankshaft rotation to the third vane rotor; a rotation transmission member to rotate the first and second vane rotors in phase; a first housing which is fixed with the intake camshaft and which encloses the first vane rotor to define an operating chamber in the first housing; a second housing which is fixed with the exhaust camshaft and which encloses the second vane rotor to define an operating chamber in the second housing; a third housing which is fixed with the camshaft provided with the third vane rotor and which encloses the third vane rotor to define an operating chamber in the third housing; a first fluid regulating device to regulate the supply and drainage of an operating fluid to and from the operating chamber between the first housing and the first vane rotor; a second fluid regulating device to regulate the supply and drainage of the operating fluid to and from the operating chamber between the second housing and the second vane rotor; and a third fluid regulating device to regulate the supply and drainage of the operating fluid to and from the operating chamber between the third housing and the third vane rotor.

A valve timing control apparatus comprising: a drive transmission member to receive crankshaft rotation; a first follower member rotatable relative to the drive transmission member only within a limited angular range; a second follower member connected with the first follower member by a rotation transmission member to transmit rotation in phase from the first follower member and the second follower member; a first camshaft rotatable relative to the second follower member only within a limited angular range; a first operating mechanism to alter a rotational phase between the drive transmission member and the first follower member; a second operating mechanism to alter a rotational phase between the second follower member and the first camshaft; a second camshaft arranged to receive the crankshaft rotation through the drive transmission member. One of the first and second camshafts is an intake camshaft, and the other camshaft is an exhaust camshaft.

In this case, the drive transmission member may be connected with a crankshaft by a flexible connecting member to transmit the crankshaft rotation to the drive transmission member, and the drive transmission member is connected with the second camshaft by a second flexible connecting member to transmit rotation to the second camshaft. Alternatively, the crankshaft rotation is transmitted to the drive transmission member and to the second camshaft by a single flexible connecting member. In this case, there may be provided a tensioner to provide a tension to the flexible connecting member. The arrangement using the single flexible connecting member is advantageous for cost reduction.

A valve timing control apparatus according to one aspect of the invention comprises: a first drive transmission member adapted to receive rotation from a crankshaft of an engine; a second drive transmission member arranged to receive rotation from the first drive transmission member; a first follower member arranged to rotate relative to the second drive transmission member within a limited range; a second follower member connected with the first follower member by a connecting member so that rotation is transmitted in phase from the first follower member to the second follower member; a first camshaft provided with at least one cam for operating one of an intake valve and an exhaust valve of the engine and arranged to rotate relative to the second follower member within a limited range; a first operating mechanism arranged to alter a rotational phase between the second drive transmission member and the first follower member; a second operating mechanism arranged to alter a rotational phase between the second follower member and the first camshaft; and a second camshaft arranged to receive rotation of the crankshaft from the first drive transmission member.

A valve timing control apparatus according to one aspect of the invention comprises: a drive transmission member adapted to receive rotation from a crankshaft of an engine; a camshaft provided with at least one cam for operating one of an intake valve and an exhaust valve of an engine; a first follower member arranged to rotate relative to the camshaft within a limited range; a first operating mechanism arranged to alter a rotational phase between the first follower member and the camshaft; a rotation transmission member set between the drive transmission member and the first follower member; and a second operating mechanism arranged to alter a rotational phase of the first follower member with respect to the camshaft by shifting a contact point between the rotation transmission member and the drive transmission member.

According to one aspect of the invention, a valve timing control apparatus comprises: a drive transmission member to receive a crankshaft rotation; an intake or exhaust camshaft; a first VTC mechanism to alter the relative rotational phase between the drive transmission member and the camshaft only within a limited angular range; a second VTC mechanism to alter the relative rotational phase between the drive transmission member and the camshaft only within a limited angular range; and a controller to control the first and second VTC mechanism. (1) The controller may be configured to control the first and second VTC mechanisms so that both mechanisms are not actuated simultaneously. (2) The controller may be configured to control the first and second VTC mechanisms so as not to alter the relative rotational phase between the drive transmission member and the camshaft when the first and second VTC mechanisms are operated simultaneously. (3) The controller may be configured to operate the first and second VTC mechanisms simultaneously in two opposite directions. With this control configuration, the controller can change over the operating mode between the first VTC mechanism and the second VTC mechanism smoothly. (4) The controller may be configured to switch the operating mode between a first VTC mode to operating the first VTC mechanism and a second VTC mode to operating the second VTC mechanism, and to operate the first and second VTC mechanisms only for a limited time period during a transition from one to the other of the first and second VTC modes.

Each of the control examples mentioned with reference to the first embodiment can be employed in any of the other embodiments.

This application is based on a prior Japanese Patent Application No. 2004-024650 filed on Jan. 30, 2004. The entire contents of this Japanese Patent Application No. 2004-024650 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A valve timing control apparatus for an internal combustion engine, comprising:

a first operating section including a first input member adapted to receive rotation from the engine, and a first output member, the first operating section being arranged to alter a rotational phase of the first output member with respect to the first input member, and thereby to alter a rotational phase of a second camshaft, which is one of intake and exhaust camshafts of the engine, without altering the rotational phase of a first camshaft, which is the other of the intake and exhaust camshafts of the engine; and a second operating section including a second input member connected with the first output member by a connecting member, and a second output member adapted to operate the second camshaft; the second operating section being arranged to alter a rotational phase of the second output member with respect to the second input member, and thereby to alter the rotational phase of the second camshaft without altering the rotational phase of the first camshaft.

2. The valve timing control apparatus as claimed in claim 1, wherein the first operating section is arranged to allow relative rotation between the first input member and the first output member only within a limited range; the second input member is connected with the first output member by the connecting member so that the first output member and the second input member rotate in phase; the second operating section is arranged to allow relative rotation between the second input member and the second output member only within a limited range; and the second output member includes the second camshaft.

3. The valve timing control apparatus as claimed in claim 1, wherein the second output member is driven by the engine through a series combination of the first and second operating sections, the first operating section being adapted to be driven by the engine, the second operating section being driven by the first operating section, and the second output member being arranged to drive the second camshaft.

4. The valve timing control apparatus as claimed in claim 1, wherein the first operating section is arranged to alter the rotational phase between the first output member and the first input member stepwise between a most advanced state and a most retarded state; and the second operating section is arranged to alter the rotational phase between the second output member and the second input member continuously.

5. The valve timing control apparatus as claimed in claim 4, wherein an operating angle of the first operating section is set smaller than or equal to an operating angle of the second operating section.

6. The valve timing control apparatus as claimed in claim 4, wherein, when the first operating section is actuated in one of an advance direction and a retard direction, the second operating section is actuated in the other of the advance direction and the retard direction.

7. The valve timing control apparatus as claimed in claim 1, wherein the first operating section is arranged to alter the rotational phase between the first output member and the first input member continuously; and the second operating section is arranged to alter the rotational phase between the second output member and the second input member stepwise between a most advanced state and a most retarded state.

8. The valve timing control apparatus as claimed in claim 7, wherein an operating angle of the second operating section is set smaller than or equal to an operating angle of the first operating section.

9. The valve timing control apparatus as claimed in claim 7, wherein, when the second operating section is actuated in one of an advance direction and a retard direction, the first operating section is actuated in the other of the advance direction and the retard direction.

10. The valve timing control apparatus as claimed in claim 1, wherein the first operating section is arranged to alter the rotational phase between the first output member and the first input member continuously; and the second operating section is arranged to alter the rotational phase between the second output member and the second input member continuously.

11. The valve timing control apparatus as claimed in claim 1, wherein the valve timing control apparatus further comprises a controller configured to control the first and second operating sections so as not to actuate the first and second operating sections simultaneously.

12. The valve timing control apparatus as claimed in claim 1, wherein the valve timing control apparatus further comprises a controller configured to control the first and second operating sections so as to switch between a first operating state in which only the first operating section is actuated and a second operating state in which only the second operating section is actuated, and configured to actuate the first and second operating sections simultaneously only during a transient period of transition from one of the first operating state and the second operating state, to the other of the first and second operating states.

13. The valve timing control apparatus as claimed in claim 1, wherein the valve timing control apparatus further comprises a controller configured to control the first and second operating sections so as to hold the rotational phase between the camshaft and the first input member substantially unchanged when the first operating section and the second operating section are both actuated.

14. The valve timing control apparatus as claimed in claim 1, wherein the valve timing control apparatus further comprises a controller configured to control the first and second operating sections so as to actuate the first operating section and the second operating section simultaneously in opposite directions.

15. The valve timing control apparatus as claimed in claim 1, wherein the valve timing control apparatus further comprises a drive transmission member adapted to be driven by a crankshaft, and arranged to drive the first input member of the first operating section; the camshafts extend from a first side to a second side of the valve timing control apparatus; the drive member is disposed on the first side; and the first and second operating sections are disposed on the second side.

16. The valve timing control apparatus as claimed in claim 15, wherein the valve timing control apparatus includes the first and second camshafts, the second camshaft extending from a first end to a second end, and the first camshaft extending from a first end to a second end; the drive transmission member is connected with the first end of the first camshaft; the first operating section is connected with the second end of the first camshaft; and the second operating section is connected with the second end of the second camshaft.

17. The valve timing control apparatus as claimed in claim 1, wherein the valve operating apparatus further comprises:

the first and second camshafts, each extending from a first end to a second end in parallel to the other, the first operating section being connected with the second end of the first camshaft, and the second operating section being connected with the second end of the second camshaft; and a third operating section including a third input member adapted to be driven by the engine, and a third output member connected with the first end of the first camshaft, the third operating section being arranged to alter a rotational phase of third output member with respect to the third input member.

18. The valve timing control apparatus as claimed claim 1, wherein the first operating section is set in a first initial position and the second operating section is set in a second initial position in an engine starting operation.

19. The valve timing control apparatus as claimed in claim 18, wherein the first operating section includes a first holding device which holds the first operating section in the first initial position in the engine starting operation, and the second operating section includes a second holding device which holds the second operating section in the second initial position in the engine starting operation.

20. The valve timing control apparatus as claimed in claim 19, wherein each of the first holding device and the second holding device is actuated from a lock position for holding a corresponding one of the first and second operating sections in the initial position, to a release position for releasing the corresponding one of the first and second operating sections, by application of a fluid pressure produced by an oil pump driven by the engine.

21. The valve timing control apparatus as claimed in claim 18, wherein both of the first and second operating sections are initially set in the same one of a most advanced position and a most retarded position.

22. The valve timing control apparatus as claimed in claim 18, wherein at least one of the first and second operating sections includes a biasing device arranged to urge a corresponding one of the first and second operating sections toward the initial position.

23. The valve timing control apparatus as claimed in claim 18, wherein the second operating section includes a biasing device which urges the second operating section in an advance direction; and the first operating section is set in the first initial position which is a most retarded position and the second operating section is set in the second initial position which is a most advanced position in the engine starting operation.

24. The valve timing control apparatus as claimed in claim 1, wherein the valve timing control apparatus includes the first and second camshafts, and the first operating section is spaced from the first camshaft so that an axis of the first operating section is spaced from an axis of the first camshaft.

25. The valve timing control apparatus as claimed in claim 24, wherein the first camshaft is connected with the first input member of the first operating section by a connecting member.

26. The valve timing control apparatus as claimed in claim 24, wherein the first operating section is disposed between the first camshaft and the second camshaft, and arranged to transmit rotation from the first camshaft to the second camshaft through the first operating section.

27. The valve timing control apparatus as claimed in claim 1, wherein at least one of the first and second operating sections includes a valve timing control mechanism including: a housing; a vane rotor arranged to be rotatable in the housing; and a fluid regulating device arranged to shift a relative angular position of the vane rotor in the housing hydraulically.

28. The valve timing control apparatus as claimed in claim 1, wherein at least one of the first and second operating sections includes a tension control mechanism including a first wheel member, a second wheel member, a flexible connecting member connecting the first and second wheel members, and an operating member arranged to vary a condition of the flexible connecting member to alter the rotational phase of the second wheel member with respect to the first wheel member.

29. The valve timing control apparatus as claimed in claim 1, wherein the first and second operating sections are both arranged to alter a rotational phase of a first camshaft of the engine with respect to a crankshaft of the engine, without altering the rotational phase of a second camshaft of the engine, the first camshaft being one of an intake camshaft and an exhaust camshaft, and the second camshaft being the other of the intake and exhaust camshafts.

30. The valve timing control apparatus as claimed in claim 1, wherein the first and second operating sections are both separated from a crankshaft of the engine so that a rotation axis of the first operating section is away from a rotation axis of the crankshaft, and a rotation axis of the second operating section is away from the rotation axis of the crankshaft.

31. A valve timing control apparatus for an internal combustion engine, comprising:

a drive transmission member adapted to be driven by the engine;

a first camshaft driven by the drive transmission member;

a first follower member arranged to rotate relative to the drive transmission member and relative to the first camshaft within a limited range;

a second follower member connected with the first follower member by a connecting member;

a second camshaft arranged to rotate relative to the second follower member within a limited range;

a first operating mechanism arranged to alter a rotational phase between the drive transmission member and the first follower member; and a second operating mechanism arranged to alter a rotational phase between the second follower member and the second camshaft.

32. The valve timing control apparatus as claimed in claim 31, wherein one of the first and second camshafts is an exhaust camshaft and the other of the first and second camshafts is an intake camshaft; and the drive transmission member is connected with the first camshaft so that crankshaft rotation of the engine is transmitted to the first camshaft.

33. The valve timing control apparatus as claimed in claim 31, wherein the first operating mechanism includes a first input member adapted to receive rotation from the engine through the drive transmission member, and the first follower member serving as a first output member, the first operating mechanism being arranged to alter a rotational phase of the first output member with respect to the first input member; and the second operating mechanism includes the second follower member which serves as a second input member and which is connected with the first output member by the connecting member, and a second output member for driving the camshaft for the engine, the second operating mechanism being arranged to alter a rotational phase of the second output member with respect to the second input member.

34. A valve timing control apparatus for an internal combustion engine, the engine including an intake camshaft and an exhaust camshaft, the valve timing control apparatus comprising:

operating means for shifting a valve timing of a second camshaft of the engine in one of an advance direction and a retard direction by a total VTC operation angle determined by adding a first VTC operation angle and a second VTC operation angle without shifting a valve timing of a first camshaft of the engine, the first camshaft being one of the intake and exhaust camshafts, and the second camshaft being the other of the intake and exhaust camshafts; and controlling means for controlling the first VTC operation angle and the second VTC operation angle independently.

35. The valve timing control apparatus as claimed in claim 34, wherein the operating means comprises first valve timing control means for altering a phase of a first output rotation with respect to a first input rotation by the first VTC operation angle, and second valve timing control means for altering a phase of a second output rotation with respect to the first output rotation by the second VTC operation angle.

36. The valve timing control apparatus as claimed in claim 1, wherein:

the first camshaft is connected with the first input member of the first operating section so that a rotational phase of the first camshaft is invariable with respect to the first input member; and the second camshaft is driven by the second output member of the second operating section.

37. The valve timing control apparatus as claimed in claim 36, wherein the first input member of the first operating section is connected with the first camshaft so that the first input member and the first camshaft rotate as a unit.

38. The valve timing control apparatus as claimed in claim 1, wherein:

the first operating section includes a first valve timing control mechanism including: a first housing; a first vane rotor arranged to be rotatable in the first housing; and a first fluid regulating device arranged to shift a relative angular position of the first vane rotor in the first housing hydraulically;

the second operating section includes a second valve timing control mechanism including: a second housing; a second vane rotor arranged to be rotatable in the second housing; and a second fluid regulating device arranged to shift a relative angular position of the second vane rotor in the second housing hydraulically; and the first housing of the first operating section is connected by the connecting member with the second housing of the second operating section.

39. The valve timing control apparatus as claimed in claim 38, wherein:

a drive sprocket, which is adapted to be driven by a crankshaft of the engine, is connected with the first camshaft, which is the exhaust camshaft, so that the exhaust camshaft rotates as a unit with the drive sprocket;

the first housing is arranged to rotate relative to the drive sprocket and relative to the exhaust camshaft;

the first vane rotor is connected with the exhaust camshaft so that the first vane rotor, the exhaust camshaft and the drive sprocket rotate as a unit;

the first fluid regulating device is arranged to shift the relative angular position of the first vane rotor in the first housing;

the second camshaft is the intake camshaft;

the second vane rotor is connected with the intake camshaft so that the second vane rotator rotates as a unit with the intake camshaft; and the second fluid regulating device is arranged to shift the relative angular position of the second vane rotor in the second housing.

40. The valve timing control apparatus as claimed in claim 18, wherein the second operating section includes a biasing device to urge the second operating section to the second initial position, whereas the first operating section includes no biasing device.

* * * * *